US009668547B2

(12) United States Patent
Yoneoka et al.

(10) Patent No.: US 9,668,547 B2
(45) Date of Patent: Jun. 6, 2017

(54) SLIDER AND METHOD FOR REPAIRING SLIDE FASTENER

(71) Applicant: YKK Corporation, Tokyo (JP)

(72) Inventors: Morimasa Yoneoka, Toyama (JP); Haruo Matsushima, Toyama (JP)

(73) Assignee: YKK Corporation (JP)

( * ) Notice: Subject to any disclaimer, the term of this patent is extended or adjusted under 35 U.S.C. 154(b) by 102 days.

(21) Appl. No.: 14/411,676

(22) PCT Filed: Oct. 31, 2012

(86) PCT No.: PCT/JP2012/078211
§ 371 (c)(1),
(2) Date: Dec. 29, 2014

(87) PCT Pub. No.: WO2014/006773
PCT Pub. Date: Jan. 9, 2014

(65) Prior Publication Data

US 2015/0189954 A1 Jul. 9, 2015

(30) Foreign Application Priority Data

Jul. 5, 2012 (WO) ..... PCT/JP2012/067223

(51) Int. Cl.
*A44B 19/26* (2006.01)
*B21D 53/52* (2006.01)
(Continued)

(52) U.S. Cl.
CPC ..... *A44B 19/26* (2013.01); *A44B 19/62* (2013.01); *B21D 53/52* (2013.01); *B21D 53/54* (2013.01);
(Continued)

(58) Field of Classification Search
CPC ..... A44B 19/26; A44B 19/62; Y10T 24/25; Y10T 24/2582; Y10T 24/2584; Y10T 24/4973; Y10T 24/49785
See application file for complete search history.

(56) References Cited

U.S. PATENT DOCUMENTS 1,675,053 A 6/1928 Rothschild et al.
2,032,438 A 3/1936 Riecken et al.
(Continued)

FOREIGN PATENT DOCUMENTS

EP 0 537 576 A1 4/1993
JP 134013 11/1990
(Continued)

OTHER PUBLICATIONS

International Search Report, PCT Application No. PCT/JP2012/078211, Jan. 15, 2013.
(Continued)

*Primary Examiner* — Victor Batson
*Assistant Examiner* — Matthew Sullivan
(74) *Attorney, Agent, or Firm* — Kilpatrick Townsend & Stockton LLP

(57) ABSTRACT

A slider body of a slider includes a slider main member and a slider sub-member. The slider main member includes at least a portion of a first blade and at least a portion of a second blade which are connected to each other through a guide column. The slider sub-member includes a pair of first flange sections and is assembled with and fixed to the slider main member. The slider can easily be attached to a fastener chain. Since the slider stably has a predetermined distance between the first and second blades, it is possible to secure satisfactory sliding properties and operability of the slider.

11 Claims, 17 Drawing Sheets

(51) Int. Cl.
*A44B 19/62* (2006.01)
*B21D 53/54* (2006.01)

(52) U.S. Cl.
CPC ..... *Y10T 24/25* (2015.01); *Y10T 24/2582* (2015.01); *Y10T 24/2584* (2015.01); *Y10T 29/4973* (2015.01); *Y10T 29/49785* (2015.01)

(56) References Cited

U.S. PATENT DOCUMENTS 2,405,509 A * 8/1946 Marinsky ..... A44B 19/26 24/430
2,456,822 A * 12/1948 Engel ..... A44B 19/26 24/415
2,839,807 A * 6/1958 Backer ..... A44B 19/28 24/416
3,149,927 A 9/1964 Fady
3,353,256 A 11/1967 Frolich et al.
3,492,714 A 2/1970 Frolich et al.
3,574,247 A * 4/1971 Jakob ..... A44B 19/26 24/420
5,007,144 A * 4/1991 Terada ..... A44B 19/26 24/415
5,297,320 A * 3/1994 Keyaki ..... A44B 19/26 24/430
5,412,849 A * 5/1995 Fudaki ..... A44B 19/38 24/388
8,082,635 B2 * 12/2011 Leveau ..... A44B 19/28 24/416
8,539,651 B1 * 9/2013 Williams ..... A44B 19/28 24/415
9,173,457 B2 * 11/2015 Lee ..... A44B 19/26
9,232,834 B2 * 1/2016 Keyaki ..... A44B 19/308
2002/0050030 A1 * 5/2002 Takasawa ..... A44B 19/26 24/415
2010/0299886 A1 12/2010 Fodge et al.
2013/0276270 A1 * 10/2013 Hamada ..... A44B 19/308 24/427
2015/0157097 A1 6/2015 Matsushima et al.

FOREIGN PATENT DOCUMENTS

JP 5-95807 A 4/1993
JP 7-100007 A 4/1995
JP 2002-136310 A 5/2002

OTHER PUBLICATIONS

Non-Final Office Action, U.S. Appl. No. 14/411,605, mailed Jul. 25, 2016, 8 pages.
Final Office Action, U.S. Appl. No. 14/411,605, mailed Dec. 19, 2016, 8 pages.

* cited by examiner

SLIDER AND METHOD FOR REPAIRING SLIDE FASTENER

This application is a national stage application of PCT/JP2012/078211, which claims priority to PCT/JP2012/067223, both of which are incorporated herein by reference.

TECHNICAL FIELD

The invention relates to a slider configured by assembling at least two slider members with each other, and more particularly, to a slider which can be assembled and attached to element rows of a slide fastener at the same time by inserting element rows into an element guide passage and by assembling a slider body.

BACKGROUND ART

Conventionally, a slide fastener is attached to an opening of an article such as clothes and a bag and is used, and if a slider placed on the slide fastener is slid along element rows, the left and right element rows are coupled to and separated from each other so that the opening of the article is opened and closed.

Generally, a slider used for a slide fastener includes a slider body to which upper and lower blades are connected through a guide column, and a tab which is rotatably held on the slider body, and substantially Y-shaped element guide passages are formed between the upper and lower blades of the slider body, and the left and right element rows are guided by the element guide passages.

As such sliders for slide fasteners, there is known a slider (called divided slider in some cases) of a type configured by separately forming a first slider member having a first blade (e.g., lower blade) and a second slider member having a second blade (e.g., upper blade), and by coupling the first slider member and the second slider member to each other.

In the case of the divided type slider composed of a plurality of slider members, stoppers or members such as separable bottom end stops are provided on both ends of element rows of a fastener chain for example and thereafter, the slider can easily be attached to the element rows of the fastener chain. Such divided type sliders composed of a plurality of slider members are disclosed in JP 5-95807 A (patent document 1) and U.S. Pat. No. 3,149,927 (patent document 2) for example.

According to the slider described in patent document 1, a tab is attached to a slider body. In the slider body, upper and lower blades are placed in parallel to each other and the blades are connected to each other through a connecting columnar, and a substantially Y-shaped element guide passage is formed between the upper and lower blades.

As shown in FIG. 20(A) for example, in patent document 1, the slider body 100 includes a first slider member 101 and a second slider member 102 which are formed separately from each other, and the slider body 100 is configured by coupling the first and second slider members 101 and 102 to each other at a position of the connecting columnar 103.

The first slider member 101 in patent document 1 includes a lower blade 101*a* and a first divided connecting columnar 101*b* placed on a shoulder opening side end of the lower blade 101*a*, and a coupling hole 101*c* is formed in the first divided connecting columnar 101*b* such that the coupling hole 101*c* penetrates the first divided connecting columnar 101*b* in the vertical direction.

The second slider member 102 includes an upper blade 102*a*, a second divided connecting columnar 102*b* vertically suspended from a shoulder opening side end of the upper blade 102*a*, and a coupling projection 102*c* vertically suspended from a lower end surface of the second divided connecting columnar 102*b*. The coupling projection 102*c* has a circular cross section. A concave groove 102*d* is provided in an outer peripheral surface of a tip end of the coupling projection 102*c*.

An engaging projection and an engaging groove (both not shown) which engage with each other are formed on an upper end surface of the first divided connecting columnar 101*b* of the first slider member 101 and a lower end surface of the second divided connecting columnar 102*b* of the second slider member 102 for positioning the first and second slider members 101 and 102.

When the slider body 100 is assembled using the first and second slider members 101 and 102, the coupling projection 102*c* of the second slider member 102 is first fitted into the coupling hole 101*c* of the first slider member 101 while relatively positioning the first slider member 101 and the second slider member 102 utilizing the engaging projection and the engaging groove as shown in FIG. 20(B), and this fitted state is held by a jig or the like.

Next, as shown in FIG. 20(C), a punch 104 is driven into a peripheral edge of the coupling hole 101*c* in a lower surface of the lower blade 101*a* of the first slider member 101. By driving the punch 104 into the lower blade 101*a* to dig the punch 104 into the lower blade 101*a*, a portion of an inner peripheral surface of the coupling hole 101*c* of the lower blade 101*a* flows and moves, and this portion enters the concave groove 102*d* provided in the coupling projection 102*c* of the first slider member 101. As a result, the slider body 100 of patent document 1 in which the coupling projection 102*c* is fixed in the coupling hole 101*c*, and the first slider member 101 and the second slider member 102 are assembled and fixed to each other is configured.

According to the slider body 100 of patent document 1, since the first slider member 101 is fixed to the second slider member 102 utilizing plastic deformation of the lower blade 101*a*, the first slider member 101 and the second slider member 102 are strongly coupled to each other.

According to the slider body 100 of patent document 1, although a punch trace (recessed groove) is formed by driving the punch 104, the punch trace is formed on a lower surface of the lower blade 101*a*, and the punch trace is not exposed directly outside when the slide fastener is used, deterioration of a outward appearance quality is suppressed.

According to the slider described in patent document 2, a tab is attached to a slider body. In the slider body, parallely placed upper and lower blades are connected to each other through a connecting columnar, and a substantially Y-shaped element guide passage is formed between the upper and lower blades. The slider body of patent document 2 has separately formed first and second slider members, and the slider body is configured by connecting the first and second slider members to each other through the connecting columnar.

The first slider member of patent document 2 includes the lower blade and a first divided connecting columnar standing on a shoulder opening side end of the lower blade, and a plurality of holes are formed in an upper end surface of the first divided connecting columnar along the vertical direction. The second slider member of patent document 2 includes the upper blade, a second divided connecting columnar vertically suspended from a shoulder opening side end of the upper blade, and a plurality of studs projecting from a lower end surface of the second divided connecting columnar. In this case, positions of the plurality of holes formed in the first divided connecting columnar of the first slider member and positions of the plurality of studs projecting from the second divided connecting columnar of the second slider member correspond to each other.

In the case of the slider body of patent document 2, by inserting the plurality of studs of the first slider member into the plurality of holes of the first slider member, and by pressing the first slider member and the second slider member from outside such that the first divided connecting columnar of the first slider member and the second divided connecting columnar of the second slider member come into close contact with each other, the first divided connecting columnar of the first slider member and the second divided connecting columnar of the second slider member are bonded to each other.

According to this, the slider body of patent document 2 in which the first slider member and the second slider member are assembled with each other is configured. According to the slider body of patent document 2, its assembling operation is carried out easily.

CITATION LIST

Patent Documents

Patent Document 1: JP 5-95807 A
Patent Document 2: U.S. Pat. No. 3,149,927

SUMMARY OF INVENTION

Technical Problem

In the conventional sliders described in patent documents 1 and 2, the guide column which connects the upper and lower blades to each other is divided into the first divided connecting columnar and the second divided connecting columnar, the first blade (lower blade) and the first divided connecting columnar are placed on the first slider member, and the second blade (upper blade) and the second divided connecting columnar are placed on the second slider member. Therefore, as described above, the conventional slider body employs such a structure that the first divided connecting columnar and the second divided connecting columnar are bonded to each other to form the one guide column and according to this, the first slider member and the second slider member are assembled with and fixed to each other.

In generally, however, when a slider body is assembled from the first slider member and the second slider member, an assembling error is generated in some cases. Hence, in the case of the conventional slider body in which a boundary between the first slider member and the second slider member is set at the guide column like patent documents 1 and 2, there is a problem that variation (error) is prone to be generated in a dimension between the upper and lower blades of the assembled slider body, especially in a dimension between the upper and lower blades in the left and right shoulder opening side ends which is formed by sandwiching the guide column of the slider body.

If variation is generated in the dimension between the upper and lower blades of the slider body in this manner, when the slider is slid and the left and right element rows are coupled to each other, attitude and motion of the fastener element are not stabilized in the element guide passage between the upper and lower blades depending upon an assembled slider, and there is concern that the left and right element rows can not smoothly coupled to each other and that sliding properties and operability of the slider are deteriorated.

When the slider body of the patent documents 1 and 2 is assembled and the slider body is attached to the element rows of the fastener chain at the same time, the assembling operation of the slider body is carried out while aligning positions of the first and second slider members and the left and right element rows with each other when the slider body is assembled.

In this case, according to the slider body of patent documents 1 and 2, it is necessary to couple the first slider member and the second slider member to each other while positioning the left and right element rows with respect to the lower blade of the first slider member and the upper blade of the second slider member. Therefore, the assembling operation of the slider body becomes complicated and the operation efficiency is deteriorated.

Further, in the case of the slider body 100 of patent document 1, while maintaining the state where the coupling projection 102*c* of the second slider member 102 is fitted into the coupling hole 101*c* of the first slider member 101, the second slider member 102 is fixed to the first slider member 101 utilizing the plastic deformation of the lower blade 101*a* by driving the punch 104 as described above.

Hence, the slider body 100 of patent document 1 is of doubtful usefulness because contents of its assembling operation are meticulous and complicated. Further, since the slider body 100 is assembled utilizing plastic deformation of the lower blade 101*a* by driving the punch 104, there is concern that variation is generated in coupling strength (fixing strength) between the first slider member 101 and the second slider member 102 depending upon the driving position of the punch 104.

The slider body of patent document 2 is assembled by inserting the plurality of studs of the first slider member into the plurality of holes of the first slider member, and by pressing the first and second slider members against each other such that the first divided connecting columnar of the first slider member and the second divided connecting columnar of the second slider member come into close contact with each other as described above.

Hence, although the assembling operation of the slider body of patent document 2 is simple as compared with the slider body of patent document 1, since the first slider member and the second slider member are basically fixed only by the studs in the slider body of patent document 2, sufficient coupling strength (fixing strength) between the first and second slider members can not be obtained in some cases.

Therefore, when the tab of the slider is strongly pulled to slide the slider of patent document 2 along the element rows of the slide fastener, the slider body is disassembled into the first slider member and the second slider member in some cases.

The invention has been accomplished in view of the conventional problem, and it is an object of the invention to provide a slider for a slide fastener and a method for repairing a slide fastener utilizing such a slider in which a slider body is configured by strongly assembling a plurality of slider members, an assembling operation of the slider body is simple and easy, variation in a dimension between first and second blades in the slider body can be less prone to be generated.

Solution to Problem

To achieve the above object, a slider for a slide fastener of the invention including: a slider body including at least a first blade, a second blade opposed to the first blade, a guide column for connecting shoulder opening side ends of the first and second blades to each other, and a pair of first flange sections placed on left and right side edges of the first blade and extending toward left and right side edges of the second blade; and a tab placed on at least one of the first and second blades, in which the slider body includes an element guide passage surrounded by element guide surfaces of inner wall surfaces of at least the first blade, the second blade and the pair of first flange sections, being characterized in that the slider body includes a slider main member and a slider sub-member formed independently from the slider main member, the slider main member (21, 31, 41, 51, 71, 91) is formed by integrally connecting a portion including at least the element guide surface of the shoulder opening side end of the first blade (12, 17, 18, 19, 61, 81) and a portion including at least the element guide surface of the shoulder opening side end of the second blade (11, 62, 82) through the guide column (13, 63, 83), and the slider sub-member includes the pair of first flange sections and is assembled with and fixed to the slider main member.

In the slider of the invention, it is preferable that the slider main member includes an element guide surface on a side of the first blade which is continuous from an shoulder opening side end edge to a rear opening-side end edge, and an element guide surface on a side of the second blade which is continuous from a shoulder opening side end edge to a rear opening-side end edge.

In the slider of the invention, it is preferable that the first blade includes a first main body which is placed on the slider main member and which includes the element guide surface, and a second main body which is placed on the slider sub-member, which connects the pair of first flange sections, and which is assembled with the first main body.

In the slider of the invention, it is preferable that the fitting portion provided on the second main body is fitted into a fitted portion provided in the first main body, and the slider sub-member is assembled with and fixed to the slider main member.

In this case, it is especially preferable that the fitted portion of the slider main member includes a recessed first fitted portion placed in the shoulder opening side end of the first main body, and a second fitted portion outwardly projecting in a width direction of the slider from left and right side edges of the first main body, the second main body includes a base portion, foundation portions which are placed on left and right side edges of the base portion and which supports the first flange sections, and an extending portion which extends from the base portion toward a shoulder and which can resiliently deform, and the fitting portion of the slider sub-member includes the hook-shaped first fitting portion which stands on a tip end of the extending portion and which is fitted into the first fitted portion, and the concave groove-shaped second fitting portion which is recessed in the foundation portion and which is fitted into the second fitted portion.

It is possible to employ a configuration that the fitted portion of the slider main member includes the concave groove-shaped first fitted portion placed in the shoulder opening side end of the first main body, and the concave groove-shaped second fitted portion placed in the rear opening-side end of the first main body, and the second main body includes the hook-shaped first fitting portion which is placed on the shoulder opening side end of the second main body and which can be fitted into the first fitted portion, and the hook-shaped second fitting portion which is placed on the rear opening-side end of the second main body and which can be fitted into the second fitted portion.

In this case, it is preferable that the second main body includes the base portion, the pair of cutouts formed on a rear opening-side end of the base portion, and a tongue piece portion which is sandwiched between the pair of cutouts and which can resiliently deform, and the first fitting portion stands on a shoulder opening side end of the base portion, and the second fitting portion stands on a rear opening-side end of the tongue piece portion.

In the slider of the invention, it is preferable that the slider sub-member may be assembled with and fixed to the slider main member by adhesion or welding, and that the slider sub-member may be assembled with and fixed to the slider main member using a fixing member.

In the slider of the invention, it is preferable that a pair of second flange sections extending toward the first blade is placed on left and right side edges of the second blade, the slider body further includes a slider second sub-member formed independently from the slider main member and the slider sub-member, and the slider second sub-member includes the pair of second flange sections and is assembled with and fixed to the slider main member.

The invention provides a method for repairing slide fastener in which a slider attached to a slide fastener is replaced with the slider having the above-described configuration, thereby repairing the slide fastener.

Advantageous Effect of Invention

In the slider for a slide fastener of the invention, the slider body in which the first and second blades are connected to each other through the connecting columnar includes the slider main member and the slider sub-member which can be assembled with each other. In this case, the first blade of the slider body is a blade on the side where the flange section is placed (in the invention, flange section is placed also on second blade of slider body in some cases as will be described later).

In the slider main member, a portion of the first blade including at least the element guide surface of the shoulder opening side end and a portion of the second blade including at least the element guide surface of the shoulder opening side end are integrally coupled to each other through the guide column by molding. The slider sub-member has the pair of first flange sections, and is assembled with and fixed to the slider main member.

In this case, the element guide passage surrounded by element guide surfaces composed of inner wall surfaces of at least the first and second blades and the pair of first flange section is formed in the slider body of the invention. The inner wall surfaces of the first and second blades of the slider body and the pair of the first flange sections which becomes the inner wall surfaces (element guide surfaces) of the element guide passage are composed of at least both the slider main member and the slider sub-member. Hence, it is possible to assemble the slider body by inserting the element rows of the slide fastener into the element guide passage, and the slider body can be assembled and the slider body can be attached to the element rows at the same time.

In the slider of the invention having such a slider body, the entire slider main member is integrally configured by molding. Hence, a dimension between the portion of the first blade including the element guide surface of the shoulder opening side end and a portion of the second blade including the element guide surface of the shoulder opening side end (i.e., dimension between element guide surfaces of shoulder opening side ends of first and second blades) stably has a predetermined dimension without receiving influence of assembly accuracy when the slider body is assembled from the slider main member and the slider sub-member. Therefore, it is possible to prevent variation (error) from generating in the dimension.

That is, according to the slider body of the invention, as compared with the configuration in which the first blade and the second blade are placed on the separate slider members as in patent documents 1 and 2, a dimension between the first and second blades after the slider body is assembled (especially dimension between element guide surfaces of shoulder opening side ends) can be less prone to generate variation (error). According to this, it is possible to stabilize a dimension and a form of the element guide passage formed between the first and second blades of the slider.

Therefore, when the slider of the invention is attached to the slide fastener and the slider is made to slide along the element rows, it is possible to stabilize attitude and motion of the fastener element in the element guide passage of the slider. Hence, the left and right element rows can smoothly be coupled to each other, and it is possible to secure satisfactory sliding properties and operability of the slider.

According to the slider of the invention, a portion of the first blade and a portion of the second blade are integrally placed on the slider main member through the guide column. Hence, when the slider body is assembled and the slider body is attached to the element rows of the fastener chain at the same time, it is possible to easily position the left and right element rows between the first and second blades of the slider main member and to hold this state and thereafter, it is possible to stably assemble the slider sub-member with the slider main member which holds the left and right element rows and to fix the slider sub-member to the slider main member. Therefore, according to the invention, it is possible to easily and efficiently carry out an operation for attaching the slider body to the element rows as compared with the cases of patent documents 1 and 2 for example.

In the slider of the invention, the slider main member includes the element guide surface on the side of the first blade which is continuous from the shoulder opening side end edge to the rear opening-side end edge, and the element guide surface on the side of the second blade which is continuous from the shoulder opening side end edge to the rear opening-side end edge. According to this, when the slider main member and the slider sub-member are assembled with each other to configure the slider body, it is possible to prevent a difference in level (level difference, hereinafter) from being formed in the element guide surface from the shoulder opening side end edge to the rear opening-side end edge of the slider body, and to make the element guide surface flat.

As a result, when the slider of the invention is attached to the slide fastener and is made to slide along the element rows, it is possible to avoid inconvenience such as that the fastener element is caught on the element guide surface of the slider, and to further enhance the sliding properties and the operability of the slider.

In the slider of the invention, the first blade includes the first main body which is placed on the slider main member and which includes the element guide surface, and the second main member which is placed on the slider sub-member to connect the pair of first flange sections to each other and which is assembled with the first main body. Since the first blade is composed of the first main body and the second main body, the slider main member and the slider sub-member can be configured with a relatively simple structure, and the slider sub-member can stably be assembled with the slider main member.

In the slider of the invention, the fitting portion provided on the second main body is fitted into the fitted portion provided in the first main body, and the slider sub-member is assembled with and fixed to the slider main member. According to this, it is possible to assemble the slider body more simply and more easily.

In this case, the fitted portion of the slider main member includes the recessed first fitted portion placed in the shoulder opening side end of the first main body and the second fitted portion projecting from left and right side end edges of the first main body outwardly in a width direction of the slider. The second main body includes the base portion, the foundation portion which is placed on left and right side end edges of the base portion for supporting the first flange section, and the extending portion which extends from the base portion toward the shoulder and which can resiliently deform. The fitting portion of the slider sub-member includes the hook-shaped first fitting portion which stands on a tip end of the extending portion and which is fitted into the first fitted portion, and the recessed groove-shaped second fitting portion which is recessed in the foundation portion and which is fitted into the second fitted portion.

Since the slider main member and the slider sub-member are configured in this manner, the slider main member and the slider sub-member can be provided with the fitted portion and the fitting portion by means of the simple structures, and the slider main member and the slider sub-member can strongly be fixed to each other.

According to the slider of the invention, the fitted portion of the slider main member includes the concave groove-shaped first fitted portion placed on the shoulder opening side end of the first main body and the concave groove-shaped second fitted portion placed on the rear opening-side end of the first main body. The second main body may include the hook-shaped first fitting portion which is placed on the shoulder opening side end of the second main body and which can be fitted into the first fitted portion, and the hook-shaped second fitting portion which is placed on the rear opening-side end of the second main body and which can be fitted into the second fitted portion.

In this case, the second main body includes the base portion, the pair of cutouts formed on the rear opening-side end of the base portion, and the tongue piece portion which is sandwiched between the pair of cutouts and which can resiliently deform. The first fitting portion stands on the shoulder opening side end of the base portion in the second main body, and the second fitting portion stands on the rear opening-side end of the tongue piece portion in the second main body.

Due to the configurations of the slider main member and the slider sub-member also, the slider main member and the slider sub-member can be provided with the fitted portion and the fitting portion by means of the simple structures, and the slider main member and the slider sub-member can strongly be fixed to each other.

In the slider of the invention, the slider sub-member may be assembled with and fixed to the slider main member by adhesion or welding. According to this, the slider main member and the slider sub-member can strongly be fixed to each other, and the slider body can simply and easily be assembled.

In the slider of the invention, the slider sub-member may be assembled with and fixed to the slider main member using the fixing member. According to this, the slider main member and the slider sub-member can strongly be fixed to each other, and the slider body can simply and easily be assembled.

In the slider of the invention, when the pair of second flange sections extending toward the first blade is placed on the left and right end edges of the second blade, the slider body further includes a slider second sub-member which is formed independently from the slider main member and the slider sub-member. The slider second sub-member includes the pair of second flange sections, and is assembled with and fixed to the slider main member.

Since the slider body is configured as described above, even if the flange sections are placed on both the first and second blades, the slider body can be assembled and the slider body can easily and efficiently be attached to the element rows of the fastener chain.

According to the repairing method of a slide fastener of the invention, the slide fastener is repaired by exchanging a slider attached to the slide fastener to a slider having the above-described configuration.

That is, according to the repairing method of the invention, if a slider is damaged when a slide fastener is used, the damaged slider is detached from the element rows and thereafter, a slider of the invention can easily be attached to the element rows. Hence, it is possible to repair a slide fastener efficiently. As a result, even if a slider is damaged, it is unnecessary to exchange an entire slide fastener, and it is possible to extend life of a slide fastener.

DESCRIPTION OF EMBODIMENT

A preferred embodiment of the invention will be described in detail with reference to the drawings based on Examples. The invention is not limited to Examples described below, and the invention can variously be modified only if the modified invention has substantially the same configuration as that of the invention and exerts the same working effects.

Although a case where one slider is attached to element rows of a fastener chain is described in following Examples for example, it is also possible, in the invention, to attach two sliders to the element rows of the fastener chain such that two sliders oppose at their shoulder opening side ends or rear opening-side ends facing each other.

Although a case where a tab of the slider is placed on the side of an upper blade of the slider body in following Example, it is possible, in the invention, to attach the tab on the side of the lower blade of the slider body, or to attach tabs both on the side of the upper blade and on the side of the lower blade of the slider body.

In the slider described in following Examples, the tab is held by a tab-attaching column, and the slider is configured as a so-called free slider having no locking mechanism using a locking pawl, but the invention can also be applied likewise to a slider which is not the free slider, e.g., a slider of a type in which a cover body is attached on the side of an upper surface of the upper blade instead of the tab-attaching column, and a slider of a type having a locking mechanism in which a locking pawl is placed in an element guide passage such that the locking pawl can move forward and backward.

EXAMPLE 1

Figure 1:
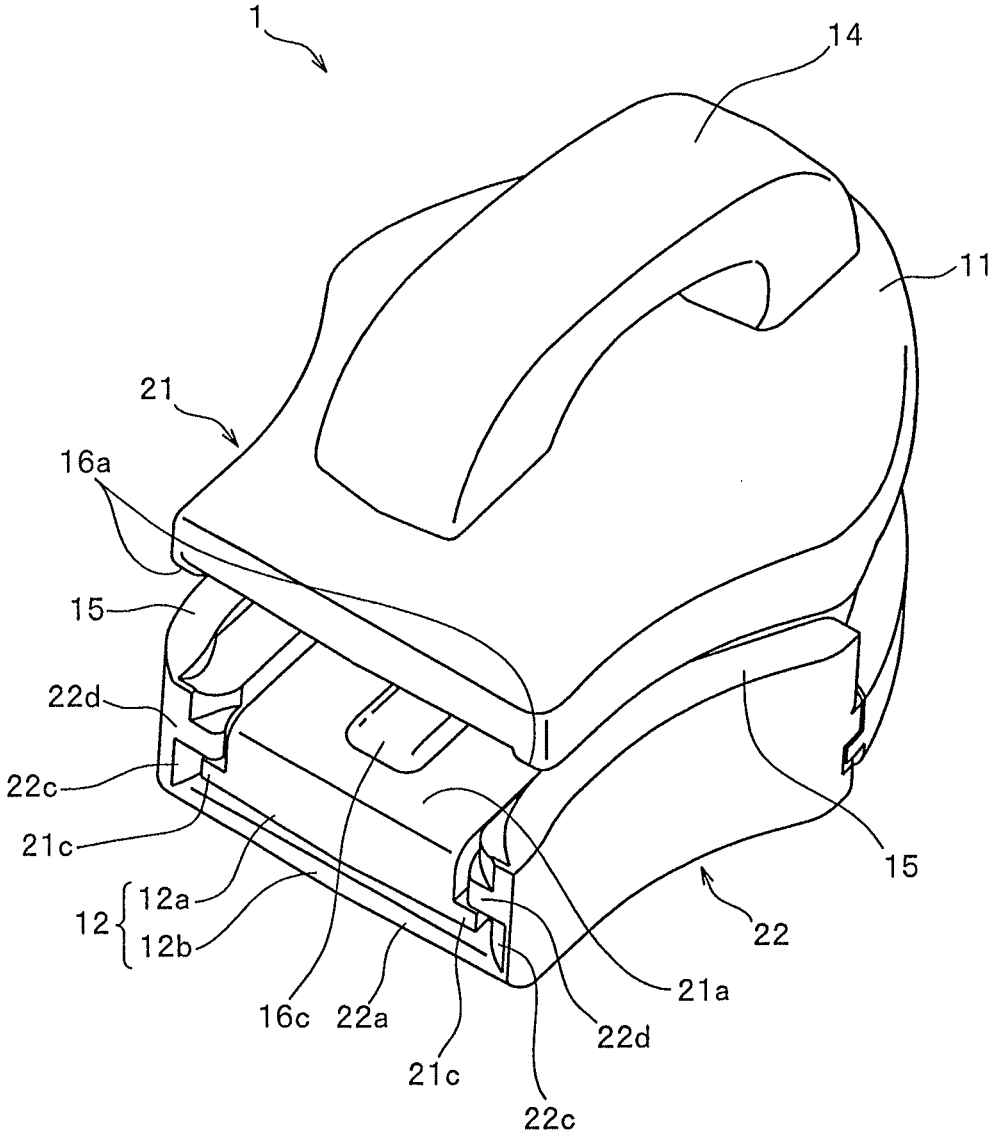
FIG. 1 is a perspective view showing a slider body of a slider according to Example 1 of the invention.
Figure 2:
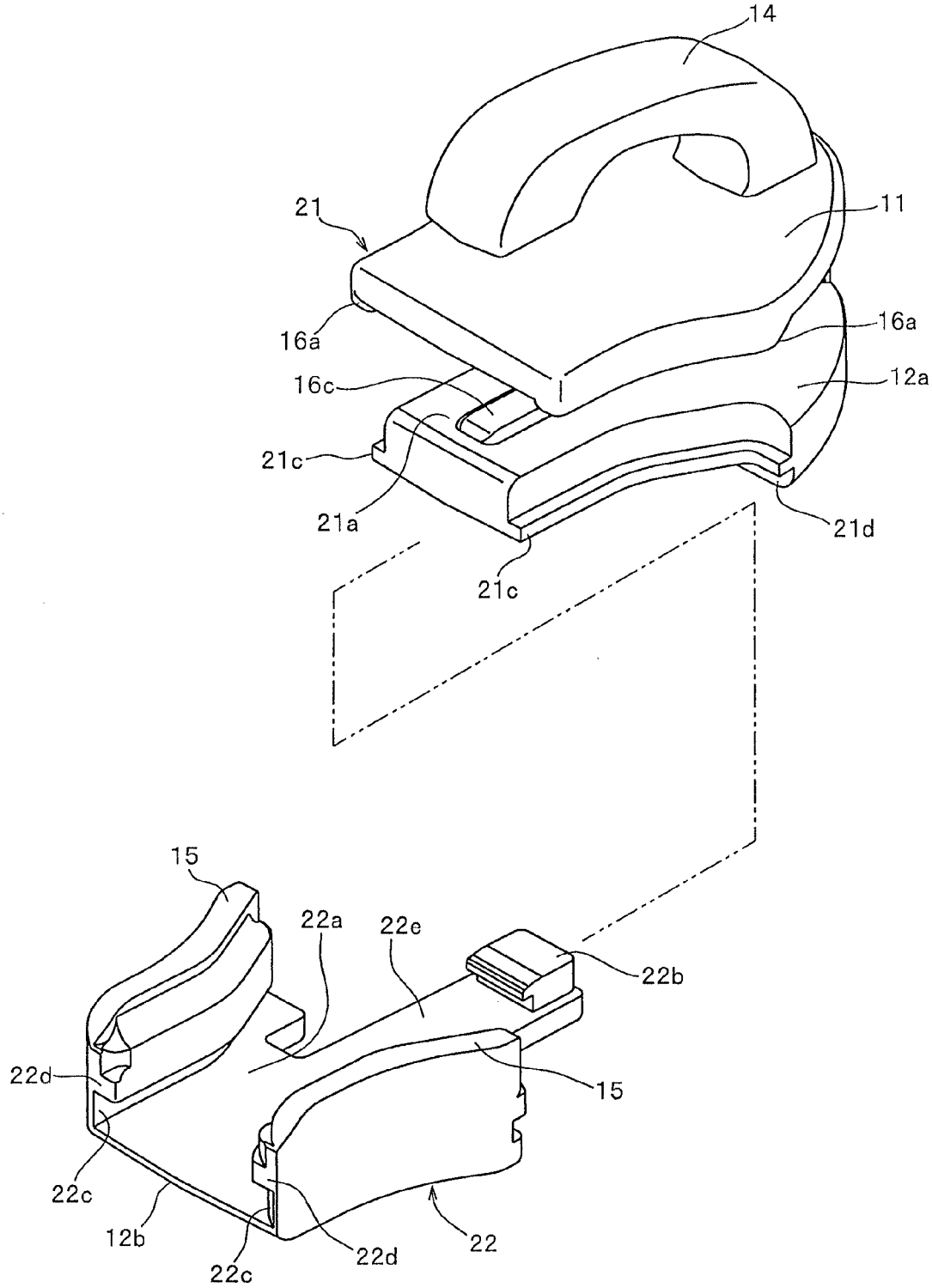
FIG. 2 is an exploded perspective view of the slider body of the slider according to Example 1 of the invention which is disassembled into a slider main member and a slider sub-member.
Figure 3:
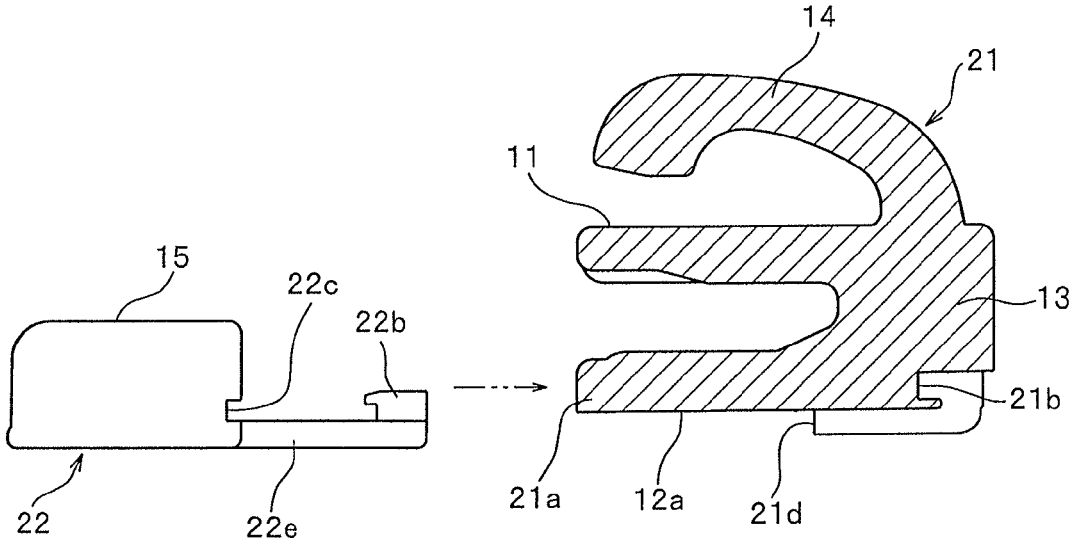
FIG. 3 is an explanatory diagram for explaining assembly of the slider main member and the slider sub-member.
Figure 4:
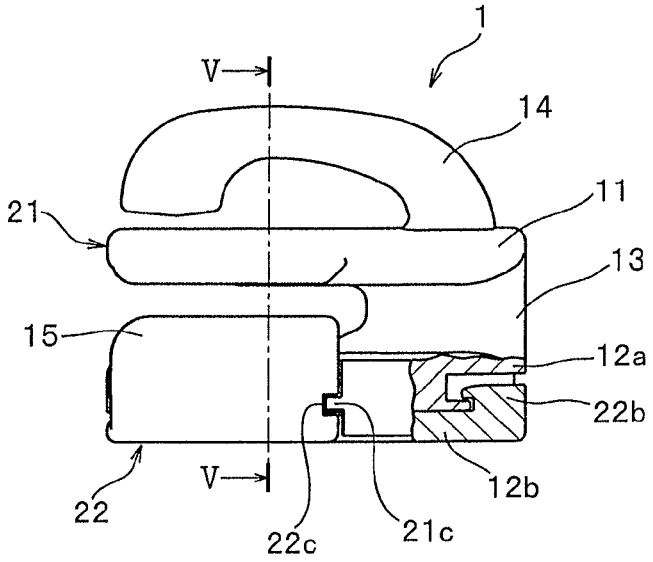
FIG. 4 is a partially sectional schematic diagram of an assembled state of the slider body of the slider according to Example 1 of the invention.

FIG. 1 is a perspective view showing a slider body of a slider for a slide fastener according to Example 1. FIG. 2 is an exploded perspective view of the slider body which is disassembled into a slider main member and a slider sub-member, and FIG. 3 is an explanatory diagram for explaining assembly of the slider main member and the slider sub-member.

In the following description, a sliding direction of the slider is defined as a longitudinal direction, especially a direction in which the slider moves to couple element rows of the slide fastener to each other is defined as a forward direction (shoulder direction), and a direction in which the slider moves to separate the element rows from each other is defined as a rearward direction (rear opening-side direction).

A height direction of the slider is defined as a vertical direction. In principle, a side from which the slide fastener is exposed outside when it is used (side where tab is attached to slider body for example) is defined as an upward direction, and a direction opposite from the upward direction is defined as a downward direction. A direction intersecting with the sliding direction of the slider at right angles, i.e., a width direction of the slider is defined as a lateral direction.

Figure 5:
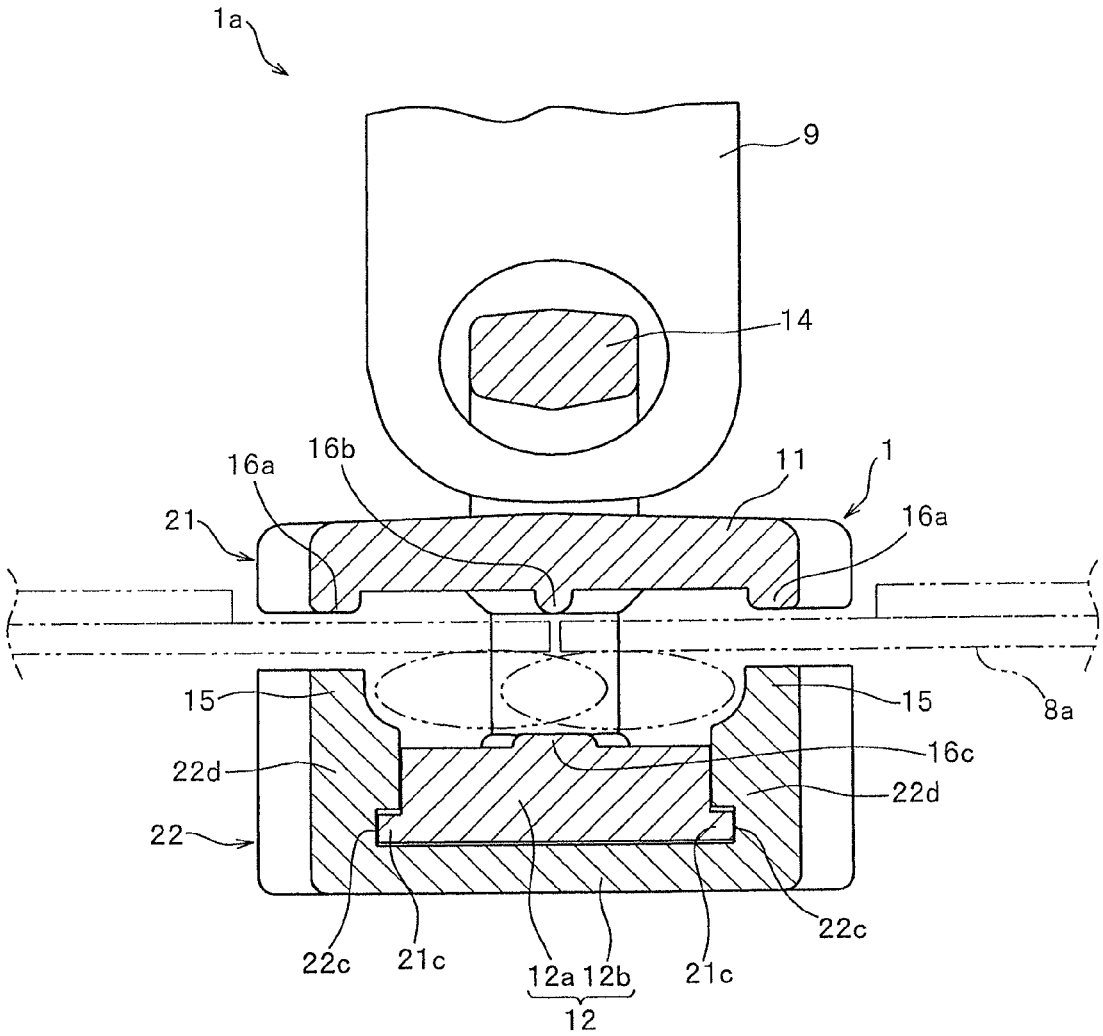
FIG. 5 is a sectional view taken along line V-V in FIG. 4.

As shown in FIG. 5, a slider 1*a* of Example 1 includes a slider body 1 and a tab 9 rotatably held on the side of an upper blade 11 of the slider body 1. The slider 1*a* of Example 1 is used for a so-called element-back using type slide fastener 8*a* in which element rows of left and right fastener stringers are placed on a lower surface side with respect to a fastener tape. In the invention, a configuration of the tab 9 is not especially limited.

The slider body 1 of Example 1 includes an upper blade 11, a lower blade 12, a guide column 13 connecting shoulder opening side ends of the upper and lower blades 11 and 12, a tab-attaching column 14 placed on the side of an upper surface of the upper blade 11, and lower flange sections 15 standing along left and right side edges of the lower blade 12. In the case of Example 1, the lower blade 12 is placed as a first blade of the invention, and the upper blade 11 is placed as a second blade of the invention.

First bulge portions 16*a* placed along left and right side edges of the upper blade 11, and a central second bulge portion 16*b* extending from the guide column 13 toward a rear end (rear opening-side end) are formed on a lower surface (element guide surface) of the upper blade 11. A third bulge portion 16*c* for guiding a fastener element of the slide fastener 8*a* is formed on an upper surface (element guide surface) of the lower blade 12 such that the third bulge portion 16*c* rearwardly extends from the guide column 13.

The entire upper blade (second blade) 11 of Example 1 is composed of a single member. The lower blade (first blade) 12 is composed of a lower blade first main body (first blade first main body) 12*a* having an element guide surface, and a lower blade second main body (first blade second main body) 12*b* attached to a lower surface (outer surface) side of the lower blade first main body 12*a*.

Left and right shoulders are formed on a front end of the slider body 1 such that the shoulders sandwich the guide column 13, and a rear opening is formed in a rear end of the slider body 1. A substantially Y-shaped element guide passage is formed such that it is surrounded by the upper blade 11, the lower blade 12 and the pair of left and right lower flange sections 15. The left and right shoulders and the rear opening-side are in communication with each other through the element guide passage. In this case, an inner wall surface (element guide surface) of the element guide passage of the slider body 1 is formed by an inner wall surface of the upper blade 11, an inner wall surface of the lower blade 12, and inner wall surfaces of the pair of left and right lower flange sections 15. Further, a tape insertion gap through which a fastener tape of the slide fastener 8*a* is inserted is formed between the upper blade 11 (especially first bulge portion 16*a*) and the lower flange sections 15.

As shown in FIG. 2, the slider body 1 in Example 1 includes a slider main member (first slider member) 21 and a slider sub-member (second slider member) 22 which can be assembled with each other. An inner wall surface (element guide surface) of the element guide passage of the slider body 1 is composed of both the slider main member 21 and the slider sub-member 22 so that the slider body 1 can be assembled and the element rows of the slide fastener 8*a* can be inserted into the element guide passage of the slider body 1 at the same time.

More specifically, the slider main member 21 includes the entire upper blade 11, the lower blade first main body 12*a* of the lower blade 12, the guide column 13 and the tab-attaching column 14 of the slider body 1. The entire slider main member 21 is integrally formed by injection molding or die casting molding. Here, the later-described lower blade second main body 12*b* of the slider sub-member 22 is attached to the lower blade first main body 12*a* and according to this, the lower blade 12 is configured together with the lower blade second main body 12*b*.

The lower blade first main body 12*a* of the slider main member 21 includes a first base portion 21*a* configuring a flat element guide surface, a recessed first fitted portion (fitted recess) 21*b* formed in the shoulder opening side end (front end) of the first base portion 21*a*, second fitted portions (projecting stripes) 21*c* placed on left and right side edges of the first base portion 21*a*, and a positioning portion 21*d* downwardly projecting from a lower surface of the first base portion 21*a*.

In this case, an upper surface (inner wall surface) of the first base portion 21*a* forms the entire element guide surface of the lower blade 12 in the slider body 1. In this invention, it is only necessary that the first base portion 21*a* of the lower blade first main body (first blade first main body) 12*a* in the slider main member 21 includes at least a region of the entire shoulder opening side end (front end) in the element guide surface of the lower blade 12 in a width direction of the slider, and it is unnecessary to include a region of the entire element guide surface of the lower blade 12 as in Example 1.

In the slider main member 21 of Example 1, the first fitted portion 21*b* of the lower blade first main body 12*a* is recessed rearward in a front end of the lower blade first main body 12*a* so that a portion (first fitting portion 22*b*) of the slider sub-member 22 is inserted and fitted into the first fitted portion 21*b*. Each of second fitted portions 21*c* is composed of projecting stripes which project outward along a direction intersecting with the vertical direction at right angles from left and right side edges of the first base portion 21*a* in a region corresponding to a portion where the lower flange sections 15 is placed when the slider body 1 is assembled. The second fitted portions 21*c* engage with portions (second fitting portions 22*c*) of the slider sub-member 22.

The positioning portion 21*d* is formed into a shape corresponding to a shape of a front end edge of a later-described second base portion 22*a* in the slider sub-member 22. By abutting the slider sub-member 22 against the positioning portion 21*d*, a position of the slider sub-member 22 in the longitudinal direction is aligned with the slider main member 21.

The slider sub-member 22 includes the lower blade second main body 12*b* which is fitted over the lower blade first main body 12*a* of the slider main member 21, and the lower flange sections 15 which are integrally formed on the lower blade second main body 12*b*. The entire slider sub-member 22 is integrally by injection molding or die casting molding for example.

The lower blade second main body 12*b* includes the second base portion 22*a* assembled with the first base portion 21*a* of the lower blade first main body 12*a* substantially in parallel with the first base portion 21*a*, left and right foundation portions 22*d* which are placed on left and right side lines of the second base portion 22*a* and which become pedestals of the lower flange sections 15, an extending portion 22*e* which extends forward (shoulder direction) from the second base portion 22*a* and which can resiliently deform in the vertical direction, a hook-shaped first fitting portion (hook portion) which is placed on a tip end of the extending portion 22*e* and which is fitted into the first fitted portion 21*b* of the slider main member 21, and the groove-shaped second fitting portions (concave grooves) 22*c* which are placed on inner walls of the foundation portions 22*d* and which are fitted into the second fitted portions 21*c* of the slider main member 21.

In this case, the second base portion 22*a* of the lower blade second main body 12*b* is placed on a rear half of the lower blade second main body 12*b* and is formed into a flat plate shape. A front end edge of the second base portion 22*a* has a shape corresponding to that of the positioning portion 21*d* of the slider main member 21.

The hook-shaped first fitting portion 22*b* stands on a tip end of the extending portion 22*e*, and an upper end of the first fitting portion 22*b* swells rearward and is formed into a hook shape. Each of the second fitting portions 22*c* is recessed toward an inner surface of the foundation portion 22*d* along the foundation portion 22*d* so that the second fitting portion 22*c* can be fitted into the second fitted portion 21*c* of the slider main member 21.

In Example 1, the second fitted portions 21*c* of the slider main member 21 are composed of projecting stripes which project from left and right side edges of the first base portion 21*a*, and the second fitting portions 22*c* of the slider sub-member 22 are composed of concave grooves which are recessed in inner surfaces of the foundation portions 22*d*.

In the invention, however, positions, dimensions and forms of the first and second fitted portions 21*b* and 21*c* of the slider main member 21 and positions, dimensions and forms of the first and second fitting portions 22*b* and 22*c* of the slider sub-member 22 can freely be changed only if the first and second fitting portions 22*b* and 22*c* of the slider sub-member 22 can appropriately be fitted respectively into the first and second fitted portions 21*b* and 21*c* of the slider main member 21. For example, it is possible to employ such a configuration that the second fitted portions 21*c* of the slider main member 21 are formed into concave grooves which are recessed in left and right side surfaces of the first base portion 21*a*, and the second fitting portions 22*c* of the slider sub-member 22 are formed into projecting stripes which project from inner surfaces of the foundation portions 22*d*.

When the slider body 1 of Example 1 is assembled using the above-described slider main member 21 and slider sub-member 22, as shown in FIGS. 2 and 3, the second fitting portions 22*c* (concave grooves) of the slider sub-member 22 are fitted into the second fitted portions 21*c* (projecting stripes) of the slider main member 21 from the rear opening sides, and the slider sub-member 22 is made to relatively slide toward the shoulder opening side of the slider main member 21. According to this, the second fitting portions 22*c* of the slider sub-member 22 are fitted into the second fitted portions 21*c* of the slider main member 21.

At this time, the extending portion 22*e* of the slider sub-member 22 resiliently deforms such that the extending portion 22*e* downwardly curves, and the hook-shaped first fitting portion 22*b* moves to an end of the shoulder opening side of the slider main member 21. Further, after the second fitting portions 22*c* of the slider sub-member 22 are fitted into the second fitted portions 21*c* of the slider main member 21, the slider sub-member 22 is strongly pushed forward against the slider main member 21, and the hook-shaped first fitting portion 22*b* standing from the tip end of the extending portion 22*e* is fitted into the first fitted portion 21*b* of the slider main member 21.

By fitting the first and second fitting portions 22*b* and 22*c* of the slider sub-member 22 respectively into the first and second fitted portions 21*b* and 21*c* of the slider main member 21 in this manner, the slider sub-member 22 is assembled with the slider main member 21, and the slider body 1 of Example 1 shown in FIG. 1 in which the slider main member 21 and the slider sub-member 22 are stably fixed to each other with predetermined fixing strength is configured.

The slider body 1 of Example 1 which is once assembled in this manner can again be disassembled into the slider main member 21 and the slider sub-member 22. For example, the first fitting portion 22*b* of the slider sub-member 22 is pulled out from the first fitted portion 21*b* of the slider main member 21 using a thin rod member while strongly pushing the slider sub-member 22 forward against the slider main member 21, and the slider sub-member 22 is relatively slid toward the rear opening-side of the slider main member 21 while curving the extending portion 22*e* of the slider sub-member 22 downward. According to this, since the second fitting portions 22*c* of the slider sub-member 22 are pulled out from the second fitted portions 21*c* of the slider main member 21, the slider main member 21 and the slider sub-member 22 can be separated from each other.

The slider 1*a* of Example 1 assembled using the slider main member 21 and the slider sub-member 22 can easily be attached to a fastener chain from which portions of the left and right element rows are separated.

More specifically, first, in a portion of the fastener chain where the left and right element rows start separating from each other, the element rows are positioned with respect to the slider main member 21 while inserting the left and right element rows between the lower blade first main body 12*a* of the slider main member 21 and the upper blade 11.

At this time, since the lower blade first main body 12*a* of the slider main member 21 and the upper blade 11 are integrally formed together through the guide column 13, the element rows can easily be inserted between the lower blade first main body 12*a* and the upper blade 11, and it is possible to stably position the element rows with respect to the slider main member 21.

Next, the slider sub-member 22 is fitted over and assembled with the slider main member 21 into which the element rows are inserted. According to this, as shown in FIG. 5, the slider body 1 in Example 1 is assembled and the element rows can be inserted into the element guide passage of the slider body 1 at the same time. Therefore, it is possible to easily and efficiently attach the slider body 1 to the fastener chain.

If the slider 1*a* having the slider body 1 which is attached in this manner is slid along the element rows of the fastener chain, the left and right element rows of the fastener chain can be coupled to and separated from each other.

Figure 6:
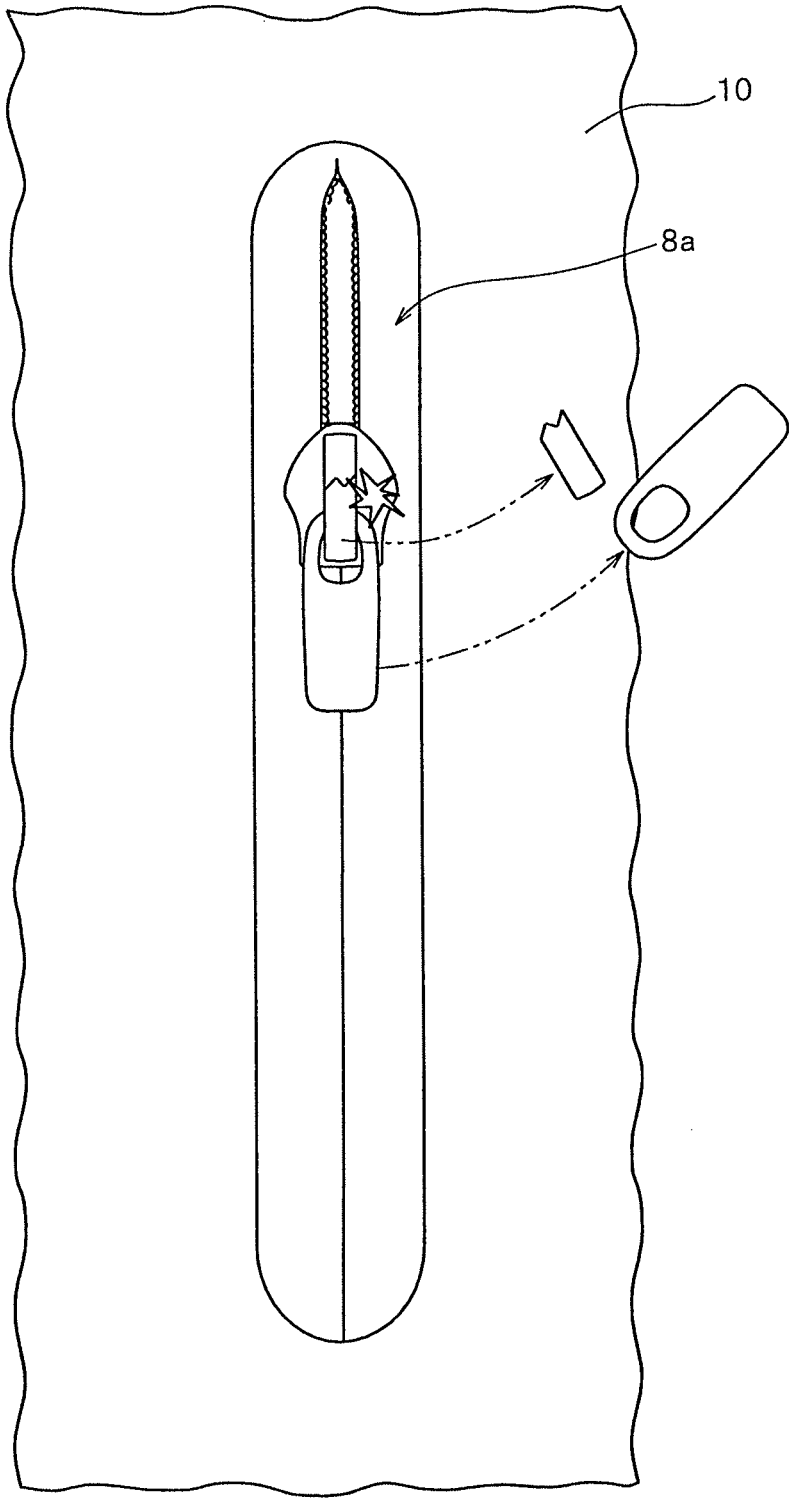
FIG. 6 is a plan view showing a slide fastener to be repaired.

Therefore, as shown in FIG. 6 for example, when a portion (e.g., tab-attaching column) of the slider of the slide fastener 8*a* attached to an article 10 such as a shoe is damaged, the damaged slider is detached from the element rows of the slide fastener 8*a* and then, the slider 1*a* of Example 1 is attached to the element rows of the slide fastener 8*a*. According to this, it is possible to easily repair the slide fastener 8*a*.

In the invention, a method to detach a damaged slider from the element rows of the slide fastener 8*a* is not especially limited. For example, a strong force is applied to a lower flange section of a damaged slider to forcibly bend the lower flange section and the slider can be detached from the element rows. When a damaged slider is the slider 1*a* of Example 1 for example, if the slider main member 21 and the slider sub-member 22 are separated from each other, the slider 1*a* can easily be detached from the element rows.

The slider 1*a* of Example 1 is preferably used not only when the above-described slide fastener 8*a* is repaired, but also when a slider is exchanged in accordance with user's interest for example.

According to the slider 1*a* of Example 1, the upper blade 11 and the lower blade first main body 12*a* are integrally formed together through the guide column 13 in the slider main member 21. Hence, a distance between the upper and lower blades 11 and 12 (especially distance between upper and lower blades 11 and 12 in shoulder opening side end) stably has a predetermined height dimension without receiving influence of assembly accuracy when the slider body 1 is assembled. A dimension error is less prone to generate in the distance between the upper and lower blades 11 and 12 (i.e., height dimension of element guide passage in vertical direction).

Therefore, according to the slider 1*a* of Example 1, since a dimension and a form of the element guide passage formed between the upper and lower blades 11 and 12 are stable, when the slider 1*a* is slid along the element rows (especially when slider 1*a* is slid in coupling direction of element rows), it is possible to stabilize attitude and motion of the fastener element in the element guide passage of the slider 1*a*. As a result, it is possible to smoothly couple and separate the left and right element rows to and from each other, and it is possible to secure satisfactory sliding properties and operability of the slider 1*a*.

Further, in the slider 1*a* of Example 1, the entire element guide surfaces of the upper and lower blades 11 and 12 are provided on the slider main member 21, it is possible to prevent a level difference from being formed on the element guide surfaces of the upper and lower blades 11 and 12 of the slider body 1 from the shoulder opening side end edge to the rear opening-side end edge, and the element guide surface is formed flat. According to this, when the slider 1*a* of Example 1 is slid along the element rows, it is possible to prevent inconvenience such as that the fastener element is caught on the element guide surface of the slider 1*a*, and to further enhance the sliding properties and the operability of the slider 1*a*.

In the slider 1*a* of Example 1, the entire element guide surface of the lower blade 12 is provided on the slider main member 21, and the lower flange sections 15 with respect to the lower blade 12 are provided on the slider sub-member 22. Therefore, a position of a boundary between the slider main member 21 and the slider sub-member 22 is set between the lower blade 12 and the lower flange sections 15 which configure the element guide passage.

However, in the invention, a portion (inner portion) of the lower blade 12 including the element guide surface of the shoulder opening side end may be provided on the slider main member, and a remaining portion (outer portion) of the lower blade 12 and the lower flange sections 15 may be provided on the slider sub-member. According to this, the position of the boundary between the slider main member and the slider sub-member may be set such that the boundary divides the lower blade 12.

In this case, it is preferable that the portion (inner portion) of the lower blade 12 placed on the side of the slider main member including the element guide surface of the shoulder opening side end is larger than the remaining portion (outer portion) of the lower blade 12 placed on the side of the slider sub-member. By sliding the slider and carrying out the opening/closing operation of the slide fastener, the left and right element rows can stably be coupled to and separated from each other.

Here, "the portion (inner portion) of the lower blade 12 including the element guide surface of the shoulder opening side end" and "the remaining portion (outer portion) of the lower blade 12" are the inner surfaces (element guide surfaces) configuring the element guide passage. Further, its "dimension" means a dimension of a surface area of each of the element guide surfaces.

EXAMPLE 2

Figure 7:
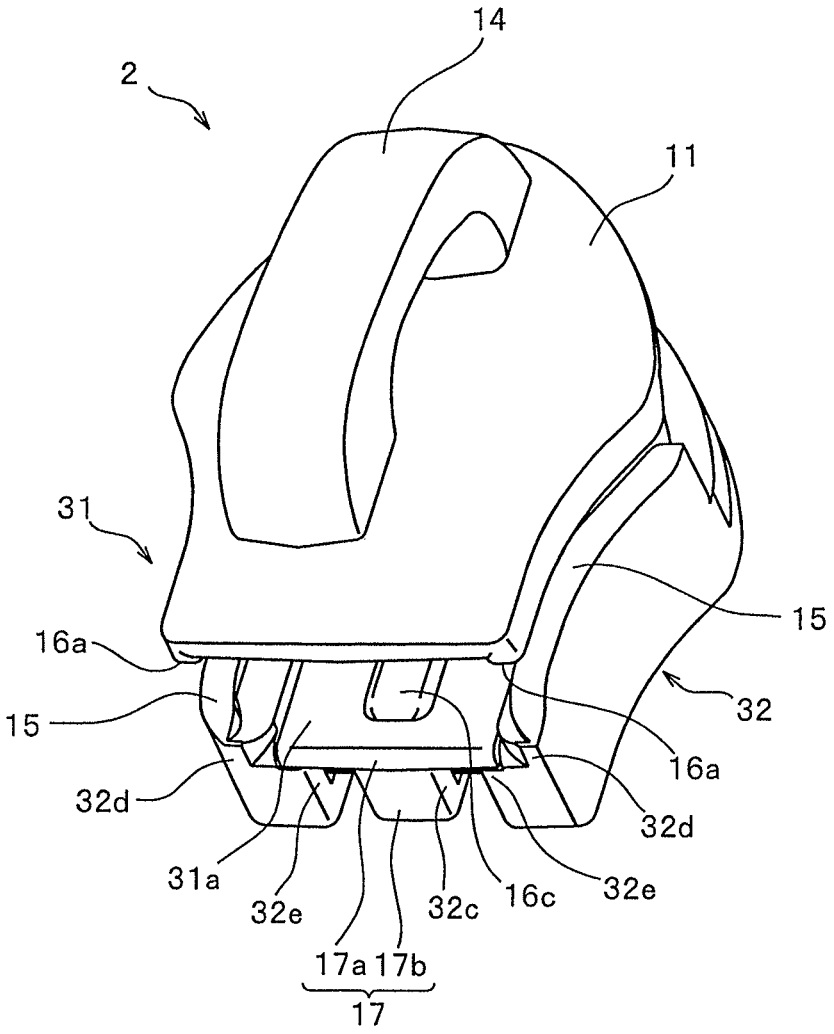
FIG. 7 is a perspective view showing a slider body of a slider according to Example 2 of the invention.
Figure 8:
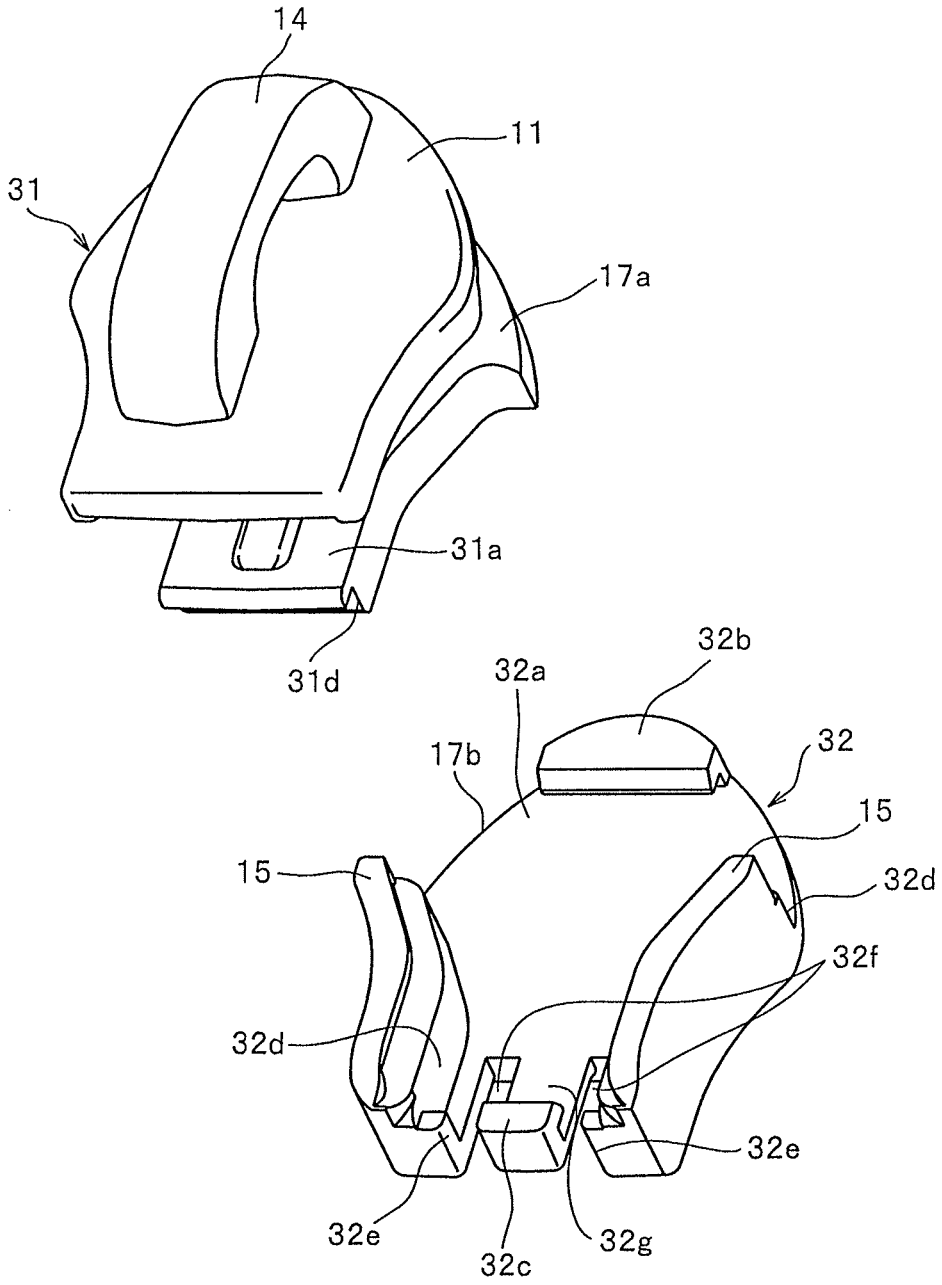
FIG. 8 is an exploded perspective view of the slider body of the slider according to Example 2 of the invention which is disassembled into a slider main member and a slider sub-member.
Figure 9:
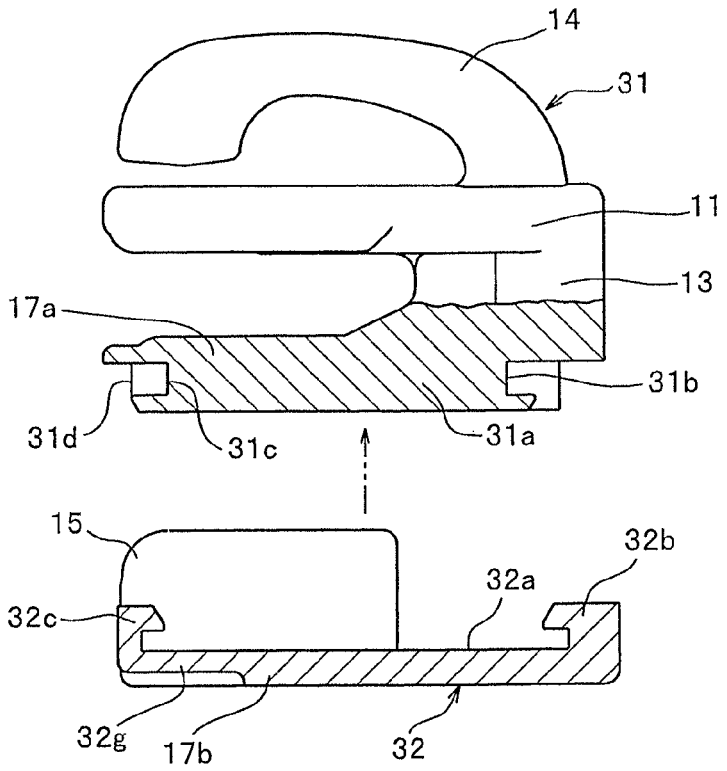
FIG. 9 is an explanatory diagram for explaining assembly of the slider main member and the slider sub-member.
Figure 10:
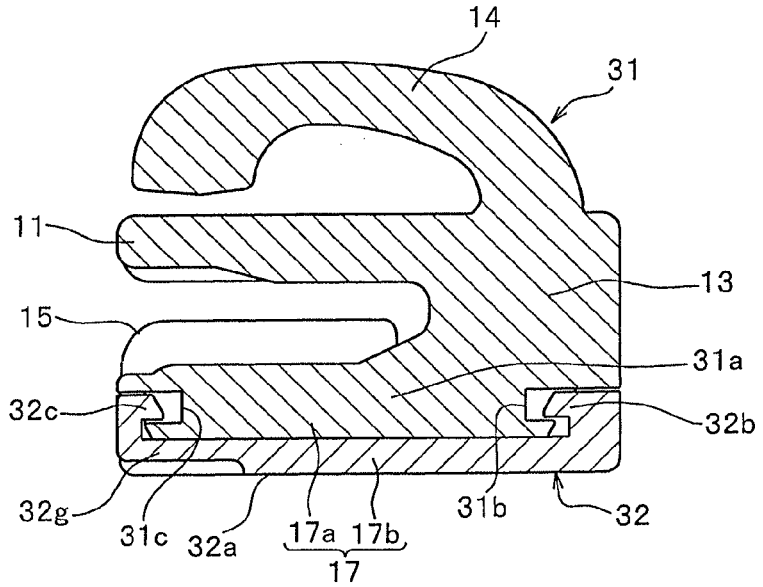
FIG. 10 is a sectional view of an assembled state of the slider body of the slider according to Example 2 of the invention.

FIG. 7 is a perspective view showing a slider body of a slider according to Example 2. FIG. 8 is an exploded perspective view of the slider body which is disassembled into a slider main member and a slider sub-member, and FIG. 9 is an explanatory diagram for explaining assembly of the slider main member and the slider sub-member. FIG. 10 is a sectional view of an assembled state of the slider body.

In the description and the drawings of Example described below, the same reference signs and names are allocated to members and portions having substantially the same configurations and function as those of Example 1, and detailed descriptions thereof will be omitted.

The slider of Example 2 includes a slider body 2 and a tab (not shown) which is rotatably held on the side of an upper blade 11 of the of the slider body 2. The slider body 2 includes a lower blade (first blade) 17, an upper blade (second blade) 11, a guide column 13 connecting shoulder opening side ends of the upper and lower blades 11 and 17 to each other, a tab-attaching column 14 placed on an upper surface side of the upper blade 11, and lower flange sections 15 standing along left and right side edges of the lower blade 17.

A substantially Y-shaped element guide passage is formed on the slider body 2 such that the element guide passage is surrounded by the upper and lower blades 11 and 17 and the pair of left and right lower flange sections 15. An inner wall surface (element guide surface) of the element guide passage is composed of an inner wall surface of the upper blade 11, an inner wall surface of the lower blade 17 and inner wall surfaces of the pair of left and right lower flange sections 15.

In Example 2, the entire upper blade 11 which becomes the second blade is composed of a single member. The lower blade 17 which becomes the first blade is composed of a lower blade first main body (first blade first main body) 17*a* having an element guide surface, and a lower blade second main body (first blade second main body) 17*b* attached to a lower surface side of the lower blade first main body 17*a*.

The slider body 2 in Example 2 includes a slider main member (first slider member) 31 and a slider sub-member (second slider member) 32 which can be assembled with each other. An inner wall surface (element guide surface) of the element guide passage of the slider body 2 is composed of both the slider main member 31 and the slider sub-member 32 so that the slider body 2 can be assembled and element rows can be inserted into the element guide passage of the slider body 2 at the same time.

In this case, the slider main member 31 includes the entire upper blade 11, the lower blade first main body 17*a* of the lower blade 17, the guide column 13 and the tab-attaching column 14 of the slider body 2. The entire slider main member 31 is integrally formed by injection molding or die casting molding.

As shown in FIG. 9, the lower blade first main body 17*a* of the slider main member 31 includes a first base portion 31*a* configuring a flat element guide surface, a concave groove-shaped first fitted portion (fitted recess) 31*b* formed in a shoulder opening side end (front end) of the first base portion 31*a*, a level difference notch portion 31*d* formed in a rear opening-side end of the first base portion 31*a*, and a concave groove-shaped second fitted portion (fitted recess) 31*c* formed in the notch portion 31*d*. In this case, an upper surface (inner wall surface) of the first base portion 31*a* forms the entire element guide surface of the lower blade 17 in the slider body 2.

The slider sub-member 32 includes a lower blade second main body 17*b* which is fitted over the lower blade first main body 17*a* of the slider main member 31, and the lower flange sections 15 which are integrally formed on the lower blade second main body 17*b*. The entire slider sub-member 32 is integrally formed by injection molding or die casting molding.

The lower blade second main body 17*b* includes a flat plate-shaped second base portion 32*a*, left and right foundation portions 32*d* which are placed on left and right side lines of the second base portion 32*a* and which become pedestals of the lower flange sections 15, and a positioning portion 32*e* which stands on a rear opening-side end of the second base portion 32*a* and which can come into contact with the notch portion 31*d* of the slider main member 31. A hook-shaped first fitting portion (first hook) 32*b* which is fitted into the first fitted portion 31*b* on the side of a front end of the slider main member 31 stands on a front end of the second base portion 32*a*.

A pair of left and right cutouts 32*f* forwardly extending from a rear end of the second base portion 32*a* and a tongue piece portion 32*g* which can resiliently deform are provided on a central portion of a rear end of the second base portion 32*a* in the width direction. The tongue piece portion 32*g* is sandwiched between the pair of cutouts 32*f*. A hook-shaped second fitting portion (second hook) 32*c* which is fitted into the second fitted portion 31*c* on the side of a rear end of the slider main member 31 stands on a rear end of the tongue piece portion 32*g*.

In this case, to make it easy to fit the first and second fitting portions 32*b* and 32*c* of the slider sub-member 32 into the first and second fitted portions 31*b* and 31*c* of the slider main member 31 when the slider sub-member 32 is assembled with the slider main member 31, inclined surfaces for guiding the first and second fitting portions 32*b* and 32*c* of the slider sub-member 32 are formed on tip ends of lower surface sides of the first and second fitted portions 31*b* and 31*c* of the slider main member 31 as shown in FIG. 9. Inclined surfaces are formed also on tip ends of the first and second fitting portions 32*b* and 32*c* of the slider sub-member 32, and the inclined surfaces downwardly incline toward the tip ends of the first and second fitting portions 32*b* and 32*c*.

In Example 2, positions, dimensions and forms of the first and second fitted portions 31*b* and 31*c* of the slider main member 31 and positions, dimensions and forms of the first and second fitting portions 32*b* and 32*c* of the slider sub-member 32 can freely be changed only if the first and second fitting portions 32*b* and 32*c* of the slider sub-member 32 can appropriately be fitted respectively into the first and second fitted portions 31*b* and 31*c* of the slider main member 31.

When the slider body 2 of Example 2 is assembled using the slider main member 31 and the slider sub-member 32, the slider sub-member 32 is brought close to the slider main member 31 from below and the slider sub-member 32 is pushed toward the slider main member 31 as shown in FIG. 9.

According to this, the first and second fitting portions 32*b* and 32*c* of the slider sub-member 32 are respectively inserted and fitted into the first and second fitted portions 31*b* and 31*c* of the slider main member 31 while resiliently and partially deforming the second base portion 32*a* of the slider sub-member 32 (especially while resiliently deforming tongue piece portion 32*g*).

Alternatively, the first fitting portion 32*b* of the slider sub-member 32 is inserted and fitted into the first fitted portion 31*b* of the slider main member 31 and thereafter, the second fitting portion 32*c* of the slider sub-member 32 is pushed toward the second fitted portion 31*c* of the slider main member 31. According to this, the second fitting portion 32*c* of the slider sub-member 32 is inserted and fitted into the second fitted portion 31*c* of the slider main member 31 while resiliently deforming the tongue piece portion 32*g* of the slider sub-member 32.

In Example 2, when the slider sub-member 32 is fitted over the slider main member 31, the positioning portion 32*e* of the slider sub-member 32 is inserted into the notch portion 31*d* of the slider main member 31. According to this, a position of the slider sub-member 32 with respect to the slider main member 31 can further be stabilized.

By fitting the first and second fitting portions 32*b* and 32*c* of the slider sub-member 32 respectively into the first and second fitted portions 31*b* and 31*c* of the slider main member 31 in this manner, the slider body 2 of Example 2 in which the slider main member 31 and the slider sub-member 32 are stably fixed to each other with predetermined fixing strength is configured.

The slider body 2 of Example 2 which is once assembled in this manner can again be disassembled into the slider main member 31 and the slider sub-member 32 by pulling out the second fitting portion 32*c* of the slider sub-member 32 from the second fitted portion 31*c* of the slider main member 31 using a thin rod member while strongly pushing the slider sub-member 32 rearward against the slider main member 31 for example.

The slider of Example 2 having such a slider body 2 can easily be attached to a fastener chain from which portions of the left and right element rows are separated like the slider body 1 of the slider 1*a* of Example 1. Therefore, the slider of Example 2 is preferably used when a slide fastener is repaired or a slider is exchanged.

Especially in the slider of Example 2, the upper blade 11 and the lower blade first main body 17*a* are integrally formed together through the guide column 13 in the slider main member 31. Hence a distance between the upper and lower blades 11 and 17 (especially distance between upper and lower blades 11 and 17 in shoulder opening side ends) stably has a predetermined height dimension, and a height dimension error in the vertical direction is less prone to generate in the element guide passage in the slider body 2.

Therefore, it is possible to smoothly couple and separate the left and right element rows to and from each other when the slider of Example 2 is slid along the element rows, and it is possible to secure satisfactory sliding properties and operability of the slider.

Further, in the slider of Example 2, the entire element guide surfaces of the upper and lower blades 11 and 17 are provided on the slider main member 31, a level difference is prevented from being formed on the element guide surfaces of the upper and lower blades 11 and 17 of the slider body 2 from the shoulder opening side end edge to the rear opening-side end edge. According to this, it is possible to further enhance the sliding properties and operability like the slider 1*a* of Example 1.

In the slider of Example 2 also, a position of a boundary between the slider main member 31 and the slider sub-member 32 is set between the lower blade 17 and the lower flange sections 15. However, in the invention, a portion (inner portion) of the lower blade 17 including the element guide surface of the shoulder opening side end may be provided on the slider main member 31, and a remaining portion (outer portion) of the lower blade 17 and the lower flange sections 15 may be provided on the slider sub-member 32. According to this, the position of the boundary between the slider main member 31 and the slider sub-member 32 may be set such that the boundary divides the lower blade 17.

EXAMPLE 3

Figure 11:
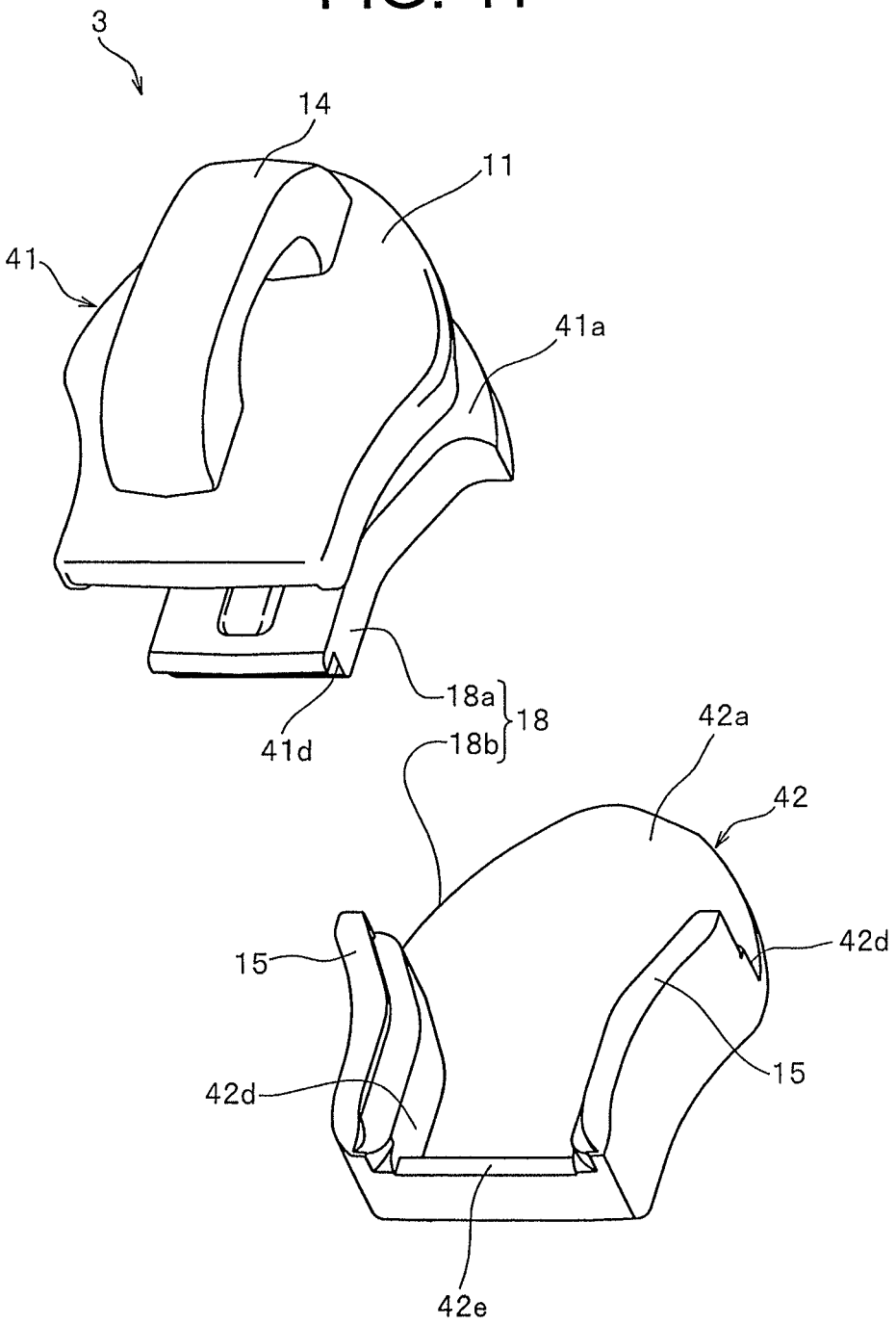
FIG. 11 is an exploded perspective view of an exploded slider body of a slider according to Example 3 of the invention.
Figure 12:
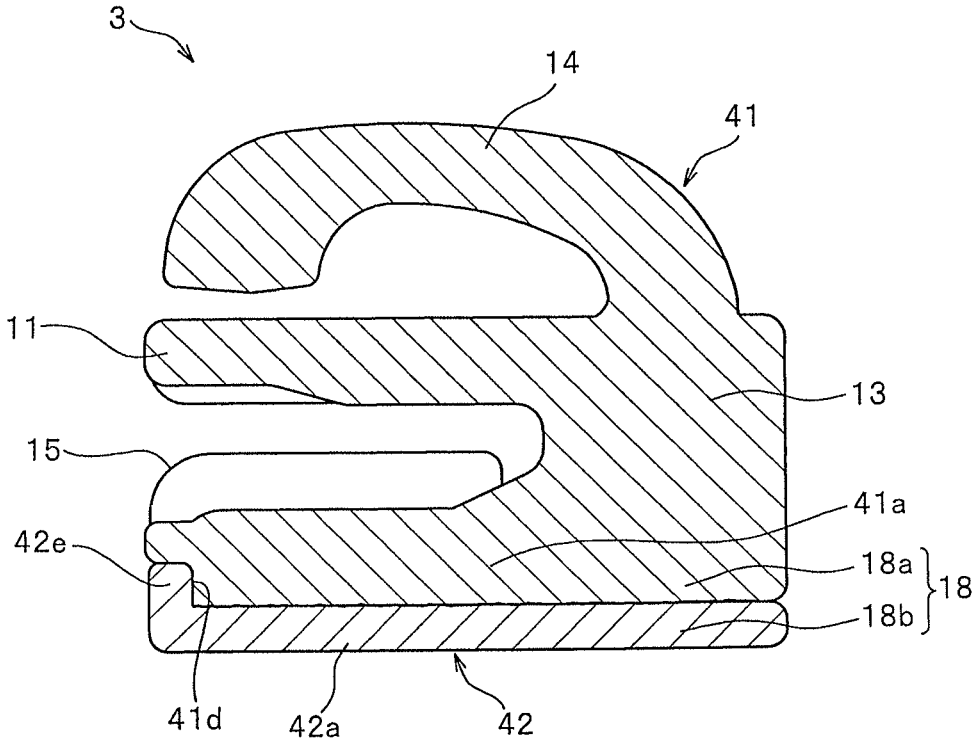
FIG. 12 is a sectional view of an assembled state of the slider body of the slider according to Example 3 of the invention.

FIG. 11 is an exploded perspective view of an exploded slider body of a slider according to Example 3, and FIG. 12 is a sectional view of an assembled state of the slider body.

The slider of Example 3 includes a slider body 3 and a tab (not shown) which is rotatably held on the slider body 3. The slider body 3 includes a lower blade (first blade) 18, an upper blade (second blade) 11, a guide column 13 connecting shoulder opening side ends of the upper and lower blades 11 and 18 to each other, a tab-attaching column 14 placed on an upper surface side of the upper blade 11, and lower flange sections 15 standing along left and right side edges of the lower blade 18.

In Example 3, the entire upper blade (second blade) 11 is composed of a single member. The lower blade (first blade) 18 includes a lower blade first main body (first blade first main body) 18*a* having an element guide surface, and a lower blade second main body (first blade second main body) 18*b* attached to a lower surface side of the lower blade first main body 18*a*.

The slider body 3 in Example 3 includes a slider main member (first slider member) 41 and a slider sub-member (second slider member) 42 which can be assembled with each other. An element guide surface of the slider body 3 is composed of both the slider main member 41 and the slider sub-member 42 so that the slider body 3 can be assembled and element rows can be inserted into the element guide passage of the slider body 3 at the same time.

In this case, the slider main member 41 includes the entire upper blade 11, the lower blade first main body 18*a* of the lower blade 18, the guide column 13 and the tab-attaching column 14 of the slider body 3, and the entire slider main member 41 is integrally configured by injection molding or die casting molding.

The lower blade first main body 18*a* of the slider main member 41 includes a first base portion 41*a* configuring a flat element guide surface, and a level difference notch portion 41*d* formed in a rear opening-side end of the first base portion 41*a*. In this case, an upper surface (inner wall surface) of the first base portion 41*a* forms an entire element guide surface of the lower blade 18 in the slider body 3.

The slider sub-member 42 includes the lower blade second main body 18*b* fitted over the lower blade first main body 18*a* of the slider main member 41, and the lower flange sections 15 which are integrally formed on the lower blade second main body 18*b*, and the entire slider sub-member 42 is integrally configured by injection molding or die casting molding.

The lower blade second main body 18*b* includes a flat plate-shaped second base portion 42*a*, left and right foundation portions 42*d* which are plated on left and right side lines of the second base portion 42*a* and which become pedestals of the lower flange sections 15, and a positioning portion 42*e* which stands on a rear opening-side end of the second base portion 42*a* and which is inserted into the notch portion 41*d* of the slider main member 41. In this case, since the positioning portion 42*e* and the left and right foundation portions 42*d* of the lower blade second main body 18*b* are connected to each other, strength of the lower blade second main body 18*b* is enhanced.

When the slider body 3 of Example 3 is assembled using the slider main member 41 and the slider sub-member 42, adhesive is applied to the entire upper surface of the second base portion 42*a* in the slider sub-member 42. Next, the second base portion 42*a* of the slider sub-member 42 is adhered to a lower surface side of the first base portion 41*a* of the slider main member 41 through adhesive such that the positioning portion 42*e* of the slider sub-member 42 is inserted into the notch portion 41*d* of the slider main member 41. In this case, it is possible to freely select one of various kinds of adhesives such as solvent volatile adhesive, thermal hardening adhesive, two-component hardening adhesive and film-shaped adhesive.

According to this, the slider body 3 of Example 3 in which the slider sub-member 42 is assembled with and fixed to the slider main member 41 is configured. In the invention, when the slider sub-member 42 is assembled with and fixed to the slider main member 41, welding means such as high frequency welding and thermal welding can be utilized instead of adhesion using the above-described adhesives.

Since it is possible to easily attach the slider of Example 3 to a fastener chain from which portions of the left and right element rows are separated as in Examples 1 and 2, the slider is preferably used when the slide fastener is repaired or when the slider is exchanged.

According to the slider of Example 3, a distance between the upper and lower blades 11 and 18 (especially distance between upper and lower blades 11 and 18 in shoulder opening side end) stably has a predetermined height dimension, and an error is less prone to generate in the height dimension in the vertical direction of the element guide passage in the slider body 3. No level difference is formed on the element guide surfaces of the upper and lower blades 11 and 18 of the slider body 3 from the shoulder opening side end edge to the rear opening-side end edge. Hence, it is possible to obtain satisfactory sliding properties and operability.

EXAMPLE 4

Figure 13:
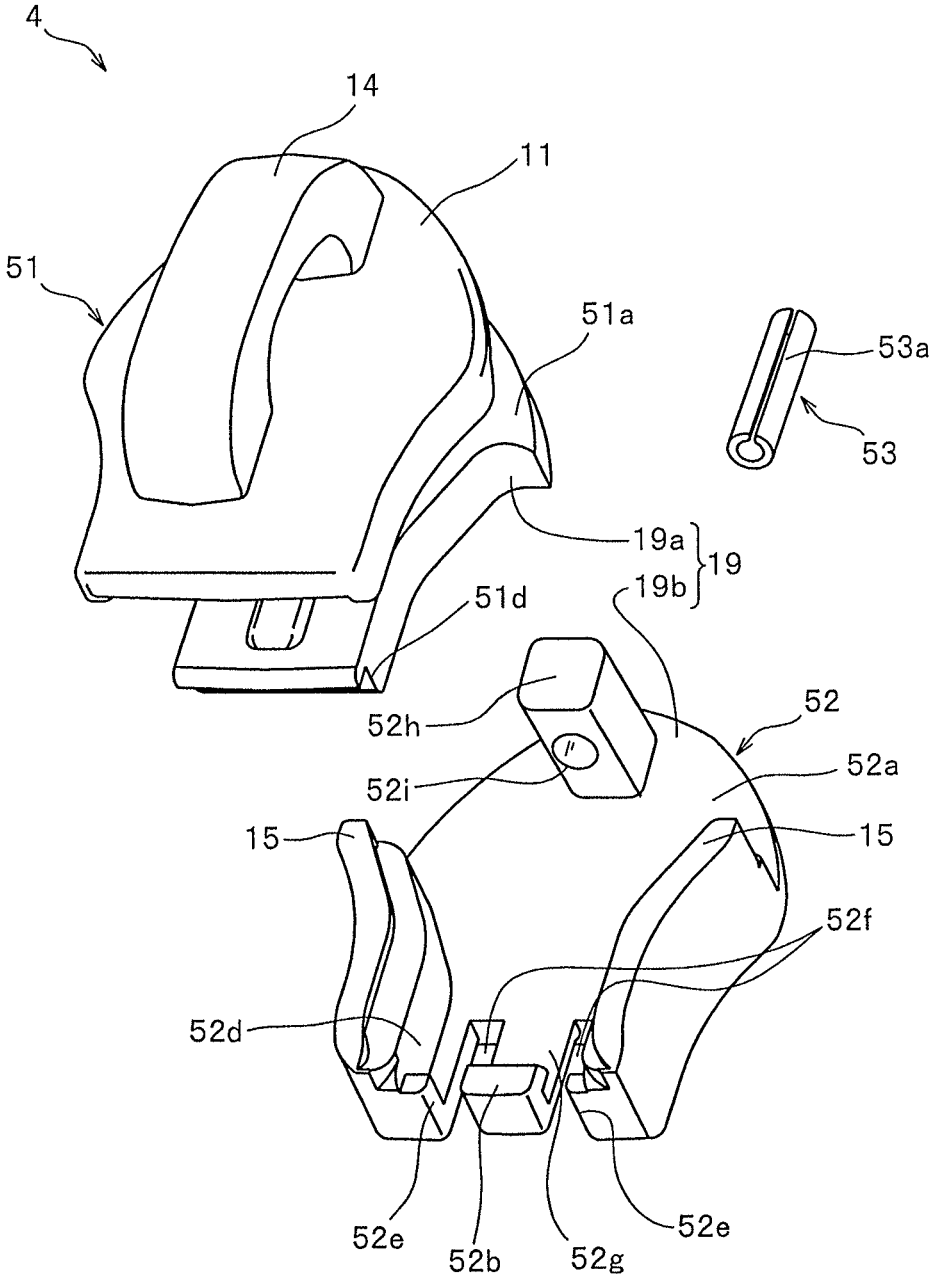
FIG. 13 is an exploded perspective view of an exploded slider body of a slider according to Example 4 of the invention.
Figure 14:
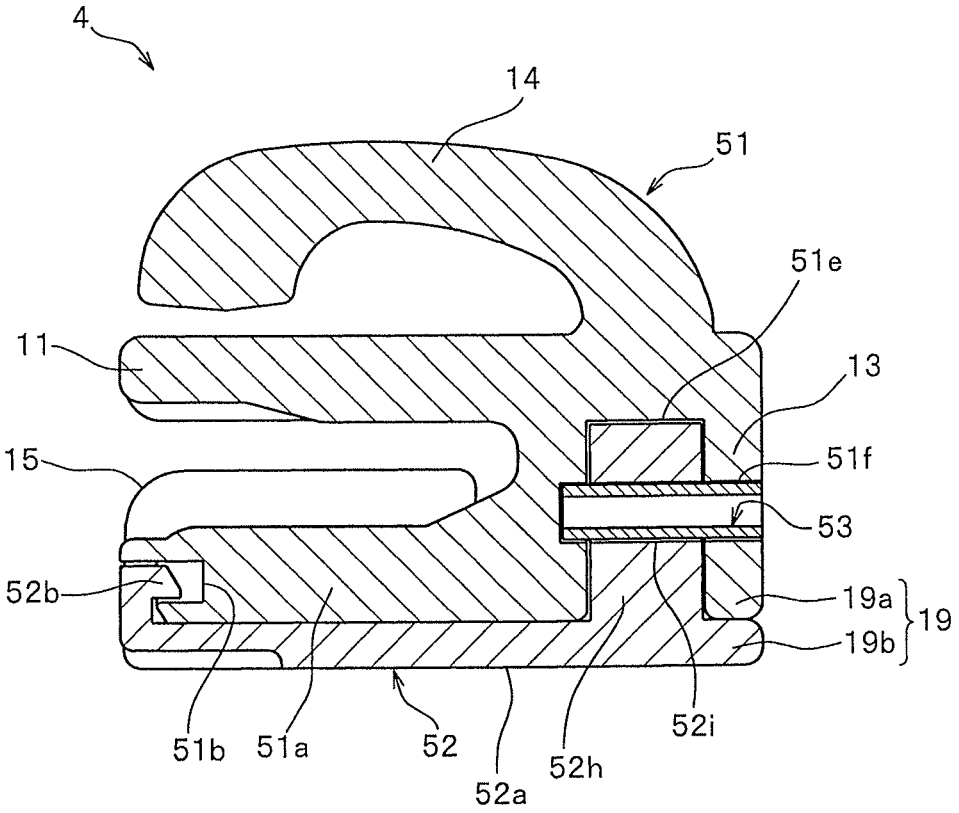
FIG. 14 is a sectional view of an assembled state of the slider body of the slider according to Example 4 of the invention.

FIG. 13 is an exploded perspective view of an exploded slider body of a slider according to Example 4, and FIG. 14 is a sectional view of an assembled state of the slider body.

The slider of Example 4 includes the slider body 4 and a tab (not shown) which is rotatably held on the slider body 4. The slider body 4 includes a lower blade (first blade) 19, an upper blade (second blade) 11, a guide column 13 connecting shoulder opening side ends of the upper and lower blades 11 and 19 to each other, a tab-attaching column 14 placed on an upper surface side of the upper blade 11, and lower flange sections 15 standing along left and right side edges of the lower blade 19.

In Example 4, the entire upper blade (second blade) 11 is composed of a single member. The lower blade (first blade) 19 includes a lower blade first main body (first blade first main body) 19*a* having an element guide surface, and a lower blade second main body (first blade second main body) 19*b* attached to a lower surface side of the lower blade first main body 19*a*.

The slider body 4 in Example 4 includes a slider main member (first slider member) 51 and a slider sub-member (second slider member) 52 which can be assembled with each other. The slider body 4 also includes a split pin member 53 for holding and fixing a state where the slider main member 51 and the slider sub-member 52 are fitted to each other. An element guide surface of the slider body 4 is composed of the slider main member 51 and the slider sub-member 52 so that the slider body 4 can be assembled and element rows can be inserted into the element guide passage of the slider body 4 at the same time.

In this case, the slider main member 51 is integrally provided with the entire upper blade 11, the lower blade first main body 19*a* of the lower blade 19, the guide column 13 and the tab-attaching column 14 of the slider body 4. As shown in FIG. 14, the lower blade first main body 19*a* and the guide column 13 of the slider main member 51 are provided with a column insertion hole 51*e* extending upward from a lower surface side of the lower blade first main body 19*a*. A later-described fixing column 52*h* of the slider sub-member 52 is inserted into the column insertion hole 51*e*.

A first pin insertion hole 51*f* into which the split pin member 53 is inserted is provided in the guide column 13 of the slider main member 51. The first pin insertion hole 51*f* rearwardly extends from a front surface side of the guide column 13. In this case, the first pin insertion hole 51*f* extends more rearward than a position where the column insertion hole 51*e* is formed so that the first pin insertion hole 51*f* intersects with the column insertion hole 51*e*.

The lower blade first main body 19*a* of the slider main member 51 includes a first base portion 51*a* configuring a flat element guide surface, a level difference notch portion 51*d* formed on a rear opening-side end of the first base portion 51*a*, and a concave groove-shaped fitted portion (fitted recess) 51*b* formed in a level difference surface oriented rearward of the notch portion 51*d*. In this case, an upper surface (inner wall surface) of the first base portion 51*a* forms an entire element guide surface of the lower blade 19 in the slider body 4.

The slider sub-member 52 is integrally provided with a lower blade second main body 19*b* fitted over the lower blade first main body 19*a* of the slider main member 51, the lower flange sections 15 integrally formed on the lower blade second main body 19*b*, and the fixing column 52*h* standing on a front end of the lower blade second main body 19*b*.

The lower blade second main body 19*b* includes a flat plate-shaped second base portion 52*a*, left and right foundation portions 52*d* which are placed on left and right side lines of the second base portion 52*a* and which become pedestals of the lower flange sections 15, and a positioning portion 52*e* which stands on a rear opening-side end of the second base portion 52*a* and which is inserted into the notch portion 51*d* of the slider main member 51.

A pair of left and right cutouts 52*f* is provided in a central portion of a rear end of the second base portion 52*a* in the width direction. The cutouts 52*f* forwardly extend from the rear end of the second base portion 52*a*. A tongue piece portion 52*g* which can resiliently deform is placed on the central portion of the rear end of the second base portion 52*a* such that the tongue piece portion 52*g* is sandwiched between the pair of cutouts 52*f*. A hook-shaped fitting portion 52*b* stands on a rear end of the tongue piece portion 52*g*. The fitting portion 52*b* is fitted into the fitted portion 51*b* of the slider main member 51.

In this case, to make it easy to fit the fitting portion 52*b* of the slider sub-member 52 into the fitted portion 51*b* of the slider main member 51 when the slider sub-member 52 is assembled with the slider main member 51, an inclined surface for guiding the fitting portion 52*b* of the slider sub-member 52 is formed on a tip end of a lower surface side of the fitted portion 51*b* of the slider main member 51 as shown in FIG. 14. An inclined surface is also formed on a tip end of the fitting portion 52*b* of the slider sub-member 52, and the inclined surface downwardly inclines toward the tip end.

The fixing column 52*h* of the slider sub-member 52 has a shape (quadrangular prism shape in the case of Example 4) corresponding to a space of the column insertion hole 51*e* provided in the slider main member 51. A second pin insertion hole 52*i* into which the split pin member 53 is inserted is formed in the fixing column 52*h* along the longitudinal direction. In this case, the second pin insertion hole 52*i* is provided at a position corresponding to that of the first pin insertion hole 51*f* of the slider main member 51 so that the second pin insertion hole 52*i* and the first pin insertion hole 51*f* are connected to each other when the slider sub-member 52 is assembled with the slider main member 51.

The split pin member 53 of Example 4 is formed cylindrically. The split pin member 53 has a straight slit 53*a* formed along a length direction of the split pin member 53. By pressing the split pin member 53 in a direction narrowing the slit 53*a*, the split pin member 53 can resiliently deform such that a diameter of the split pin member 53 is reduced.

When the slider body 4 of Example 4 having the slider main member 51, the slider sub-member 52 and the split pin member 53 is assembled, the fixing column 52*h* of the slider sub-member 52 is first fitted into the column insertion hole 51*e* of the slider main member 51.

Subsequently, the fitting portion 52*b* of the slider sub-member 52 is pushed toward the fitted portion 51*b* of the slider main member 51. According to this, the fitting portion 52*b* of the slider sub-member 52 is inserted and fitted into the fitted portion 51*b* of the slider main member 51 while resiliently deforming the tongue piece portion 52*g* of the slider sub-member 52.

According to this, the slider sub-member 52 is assembled with the slider main member 51 from a lower surface side of the lower blade first main body 19*a*. At this time, the lower blade second main body 19*b* of the slider sub-member 52 comes into intimate contact with the lower blade first main body 19*a* of the slider main member 51, and a position of the first pin insertion hole 51*f* formed in the slider main member 51 and a position of the second pin insertion hole 52*i* formed in the slider sub-member 52 are aligned with each other.

Next, in a state where the split pin member 53 is pressed and its diameter is reduced, the split pin member 53 is inserted into the first pin insertion hole 51*f* of the slider main member 51 and the second pin insertion hole 52*i* of the slider sub-member 52 from a front surface side of the slider main member 51. Thereafter, the pressed state of the split pin member 53 is released, the split pin member 53 resiliently restores and the split pin member 53 comes into the first and second pin insertion holes 52*i* under pressure. According to this, the state where the slider sub-member 52 is assembled with the slider main member 51 is held by the split pin member 53. Therefore, the slider body 4 of Example 4 in which the slider main member 51 and the slider sub-member 52 are stably fixed to each other with predetermined fixing strength is configured.

Since it is possible to easily attach the slider of Example 4 to a fastener chain from which portions of the left and right element rows are separated as in Examples 1 to 3, the slider is preferably used when the slide fastener is repaired or when the slider is exchanged.

According to the slider of Example 4, a distance between the upper and lower blades 11 and 19 (especially distance between upper and lower blades 11 and 19 in shoulder opening side end) stably has a predetermined height dimension, and an error is less prone to generate in the height dimension in the vertical direction of the element guide passage in the slider body 4. Further, no level difference is formed on the element guide surfaces of the upper and lower blades 11 and 19 of the slider body 4 from the shoulder opening side end edge to the rear opening-side end edge. Hence, it is possible to obtain satisfactory sliding properties and operability.

EXAMPLE 5

Figure 15:
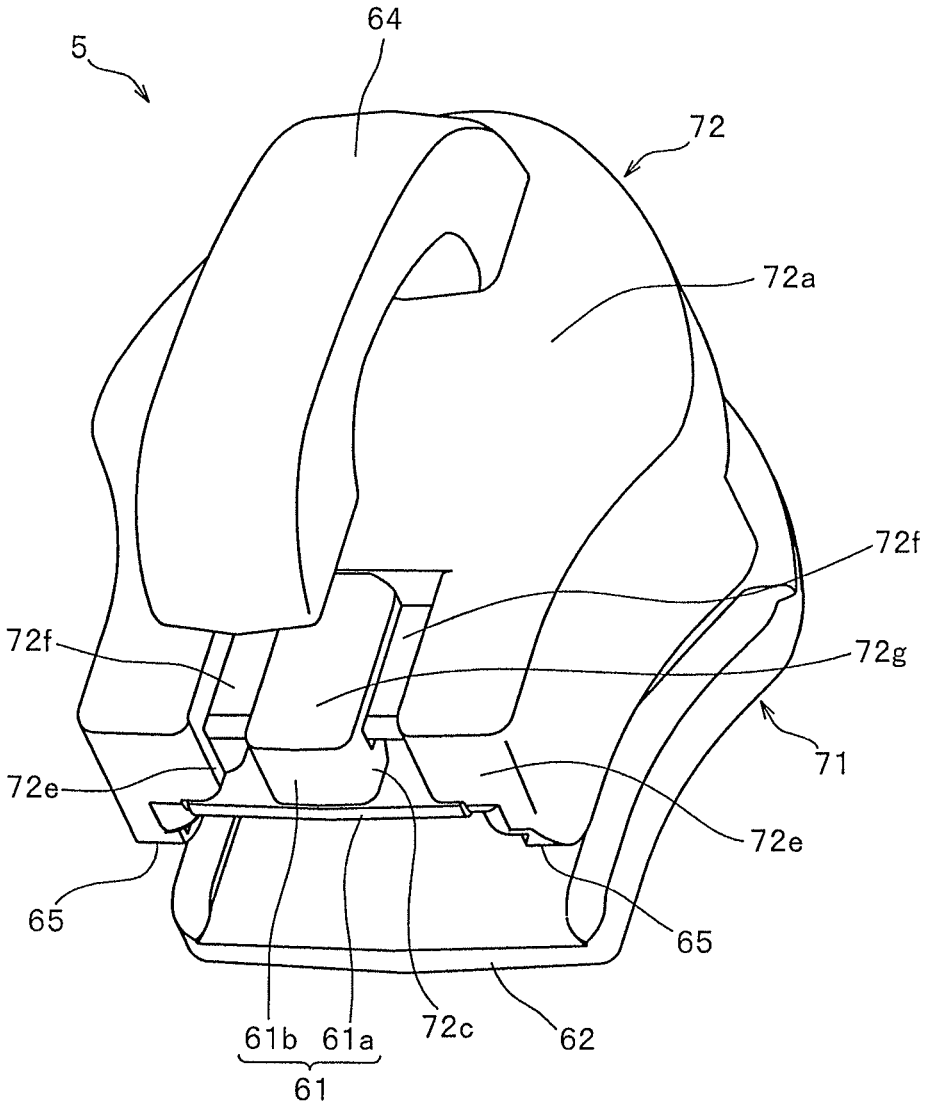
FIG. 15 is a perspective view showing a slider body of a slider according to Example 5 of the invention.
Figure 16:
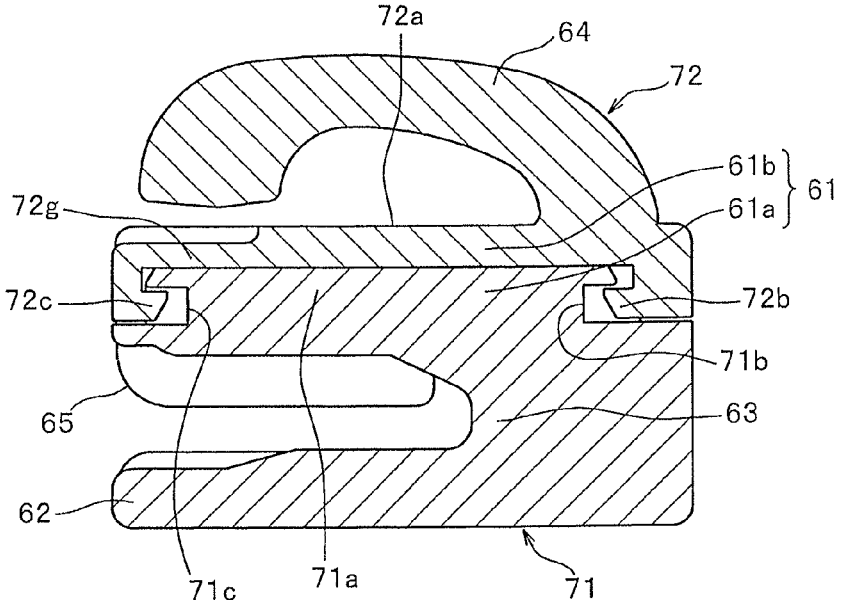
FIG. 16 is a sectional view of the slider body of the slider according to Example 5 of the invention.
Figure 17:
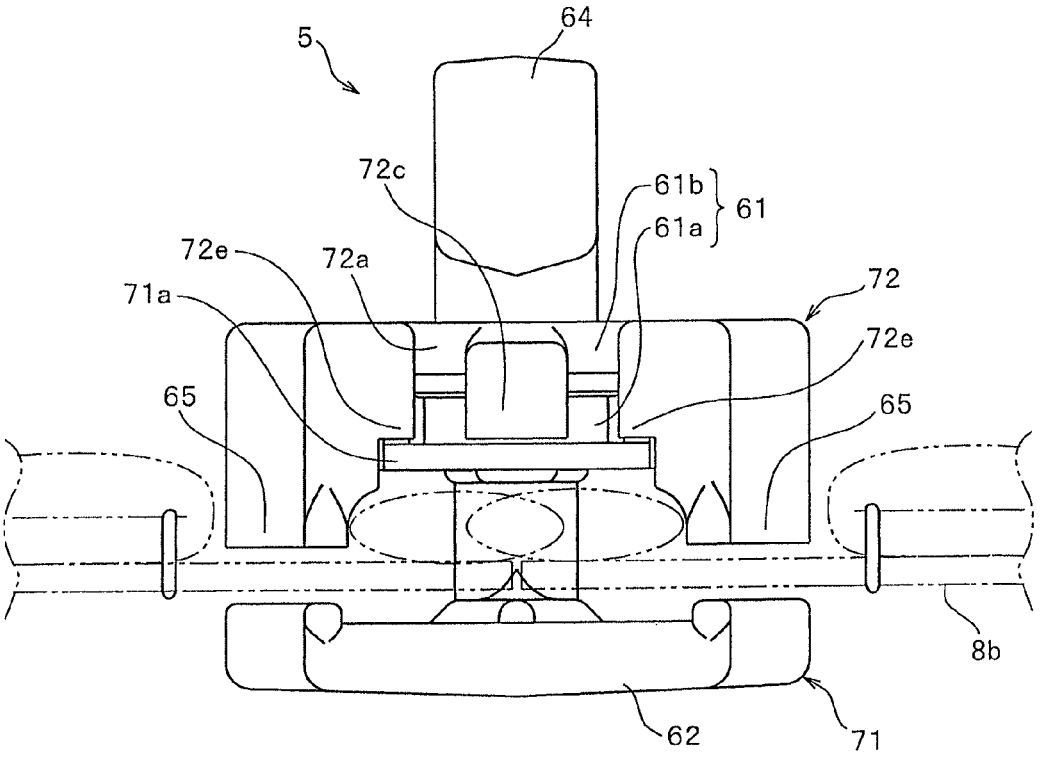
FIG. 17 is a schematic diagram of the slider body of the slider according to Example 5 of the invention as viewed from a rear opening side.

FIG. 15 is a perspective view showing a slider body of a slider according to Example 5. FIG. 16 is a sectional view of the slider body, and FIG. 17 is a schematic diagram of the slider body as viewed from a rear opening side.

The slider of Example 5 includes the slider body 5 and a tab (not shown) which is rotatably held on the slider body 5. As shown in FIG. 17 for example, the slider is used for a slide fastener 8*b* of a type in which element rows of left and right fastener stringers are placed on an upper surface side with respect to a fastener tape.

The slider body 5 of Example 5 includes an upper blade 61, a lower blade 62, a guide column 63 for connecting shoulder opening side ends of the upper and lower blades 61 and 62 to each other, a tab-attaching column 64 placed on an upper surface side of the upper blade 61, and upper flange sections 65 suspended along left and right side edges of the upper blade 61. In the case of Example 5, the upper blade 61 is placed as a first blade of the invention, and the lower blade 62 is placed as a second blade of the invention.

In Example 5, the entire lower blade 62 which becomes the second blade is composed of a single member. The upper blade 61 which becomes the first blade includes an upper blade first main body (first blade first main body) 61*a* having an element guide surface, and an upper blade second main body (first blade second main body) 61*b* attached to an upper surface side of the upper blade first main body 61*a*.

The slider body 5 in Example 5 includes a slider main member (first slider member) 71 and a slider sub-member (second slider member) 72 which can be assembled with each other. An element guide surface of the slider body 5 is composed of both the slider main member 71 and the slider sub-member 72 so that the slider body 5 can be assembled and element rows can be inserted into the element guide passage of the slider body 5 at the same time.

In this case, the slider main member 71 includes the upper blade first main body 61*a* of the upper blade 61, the entire lower blade 62 and the guide column 63 of the slider body 5, and the entire slider main member 71 is integrally configured by injection molding or die casting molding for example.

The upper blade first main body 61*a* of the slider main member 71 includes the first base portion 71*a* configuring a flat element guide surface, a concave groove-shaped first fitted portion (fitted recess) 71*b* formed in a shoulder opening side end (front end) of the first base portion 71*a*, a level difference notch portion formed in a rear opening-side end of the first base portion 71*a*, and a concave groove-shaped second fitted portion (fitted recess) 71*c* formed in a level difference oriented rearward of the notch portion. In this case, a lower surface (inner wall surface) of the first base portion 71*a* forms an entire element guide surface of the upper blade 61 in the slider body 5.

The slider sub-member 72 includes the upper blade second main body 61*b* fitted over the upper blade first main body 61*a* of the slider main member 71, the upper flange section 65 integrally formed on the upper blade second main body 61*b*, and the tab-attaching column 64. The entire slider sub-member 72 is integrally configured by injection molding or die casting molding for example.

The upper blade second main body 61*b* includes a flat plate-shaped second base portion 72*a*, left and right foundation portions which are placed on left and right side lines of the second base portion 72*a* and from which the upper flange sections 65 suspend, and a positioning portion 72*e* which suspends from a rear opening-side end of the second base portion 72*a* and which is inserted into a notch portion of the slider main member 71. A hook-shaped first fitting portion 72*b* suspends from a front end of the second base portion 72*a*. The first fitting portion 72*b* is fitted into the first fitted portion 71*b* on the side of front end of the slider main member 71.

A pair of left and right cutouts 72*f* is provided in a central portion of a rear end of the second base portion 72*a* in the width direction. The cutouts 72*f* forwardly extend from the rear end of the second base portion 72*a*. A tongue piece portion 72*g* which can resiliently deform is placed on the central portion of the rear end of the second base portion 72*a* such that the tongue piece portion 72*g* is sandwiched between the pair of cutouts 72*f*. A hook-shaped second fitting portion 72*c* suspends from a rear end of the tongue piece portion 72*g*. The fitting portion 72*c* is fitted into the fitted portion 71*c* on the side of a rear end of the slider main member 71.

In this case, to make it easy to fit the first and second fitting portions 72*b* and 72*c* of the slider sub-member 72 into the first and second fitted portions 71*b* and 71*c* of the slider main member 71 when the slider sub-member 72 is assembled with the slider main member 71, inclined surfaces for guiding the first and second fitting portions 72*b* and 72*c* of the slider sub-member 72 are formed on tip ends of upper surface sides of the first and second fitted portions 71*b* and 71*c* of the slider main member 71 as shown in FIG. 16. Inclined surfaces are also formed on tip ends of the first and second fitting portions 72*b* and 72*c* of the slider sub-member 72, and the inclined surfaces upwardly incline toward the tip ends.

When the slider body 5 of Example 5 is assembled using the slider main member 71 and the slider sub-member 72, the slider sub-member 72 is brought close to the slider main member 71 from above, and the slider sub-member 72 is pushed toward the slider main member 71. According to this, the first and second fitting portions 72*b* and 72*c* of the slider sub-member 72 are respectively inserted and fitted into the first and second fitted portions 71*b* and 71*c* of the slider main member 71 while partially resiliently deforming the second base portion 72*a* of the slider sub-member 72 (especially while resiliently deforming the tongue piece portion 72*g*).

Alternatively, the first fitting portion 72*b* of the slider sub-member 72 is inserted and fitted into the first fitted portion 71*b* of the slider main member 71 and thereafter, the second fitting portion 72*c* of the slider sub-member 72 is pushed toward the second fitted portion 71*c* of the slider main member 71. According to this, the second fitting portion 72*c* of the slider sub-member 72 is inserted and fitted into the second fitted portion 71*c* of the slider main member 71 while resiliently deforming the tongue piece portion 72*g* of the slider sub-member 72.

In Example 5, when the slider sub-member 72 is fitted over the slider main member 71, the positioning portion 72*e* of the slider sub-member 72 is inserted into the notch portion of the slider main member 71. According to this, a position of the slider sub-member 72 with respect to the slider main member 71 can further be stabilized.

By fitting the first and second fitting portions 72*b* and 72*c* of the slider sub-member 72 respectively into the first and second fitted portions 71*b* and 71*c* of the slider main member 71 in this manner, the slider body 5 of Example 5 in which the slider main member 71 and the slider sub-member 72 are stably fixed to each other with predetermined fixing strength is configured.

According to the slider of Example 5 having such a slider body 5, the same working effects as those of Examples 1 to 4 can be exerted.

If the second fitting portion 72*c* of the slider sub-member 72 is pulled out from the second fitted portion 71*c* of the slider main member 71 for example, the slider body 5 of Example 5 which is once assembled in this manner can again be disassembled into the slider main member 71 and the slider sub-member 72.

EXAMPLE 6

Figure 18:
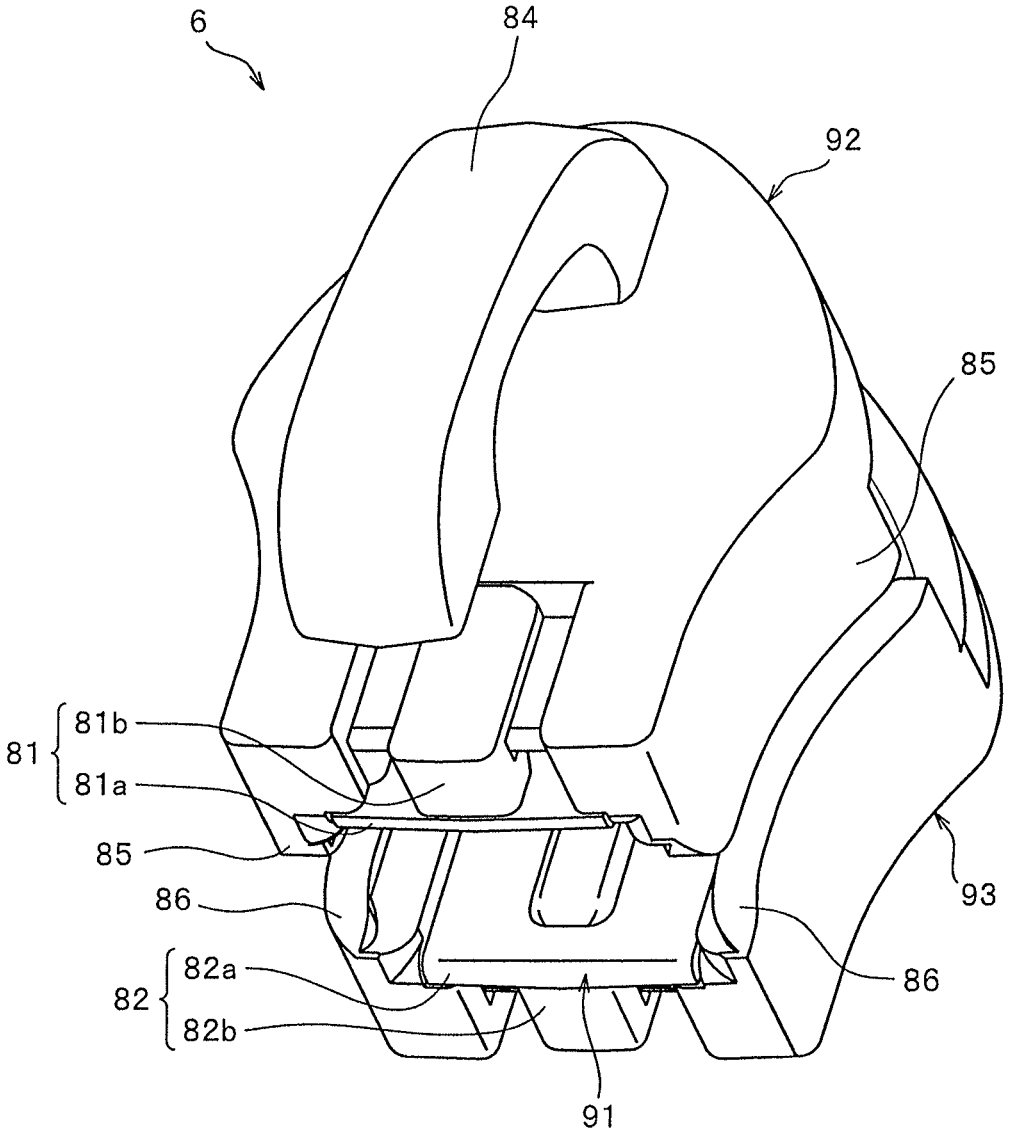
FIG. 18 is a perspective view showing a slider body of a slider according to Example 6 of the invention.
Figure 19:
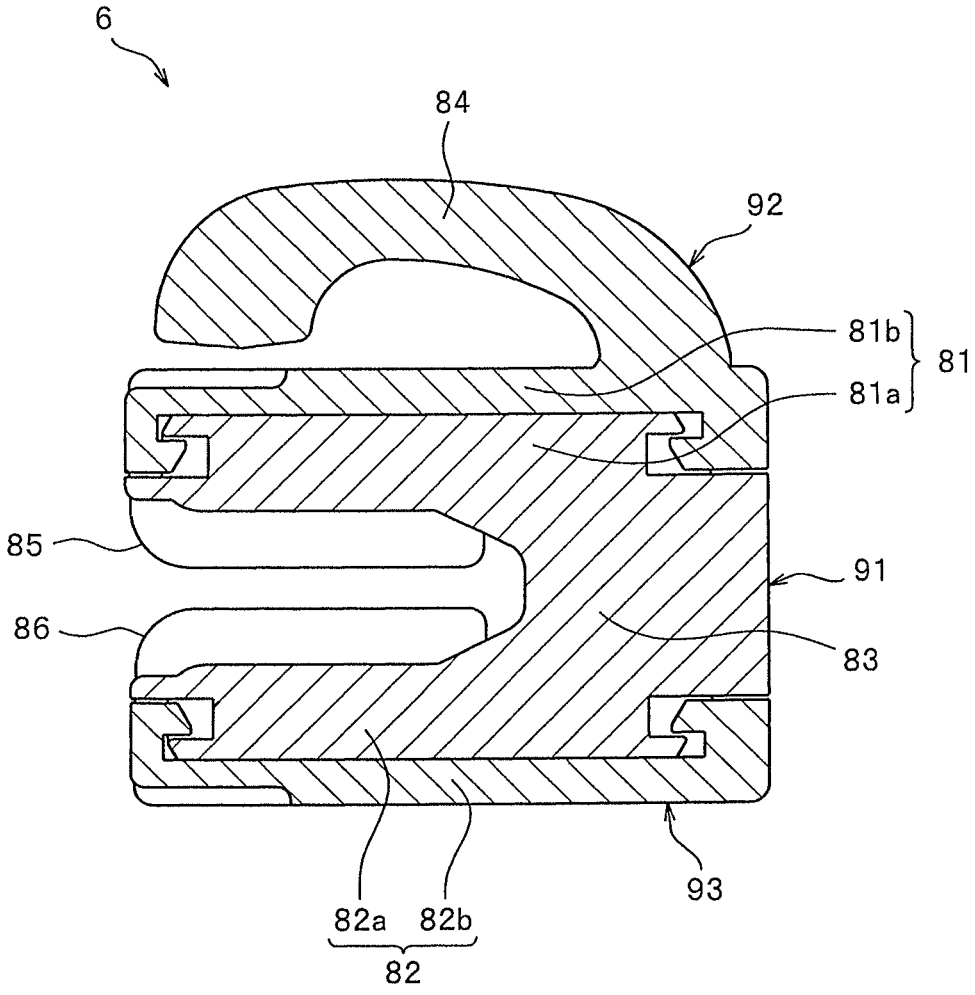
FIG. 19 is a sectional view of the slider body of the slider according to Example 6 of the invention.
Figure 20:
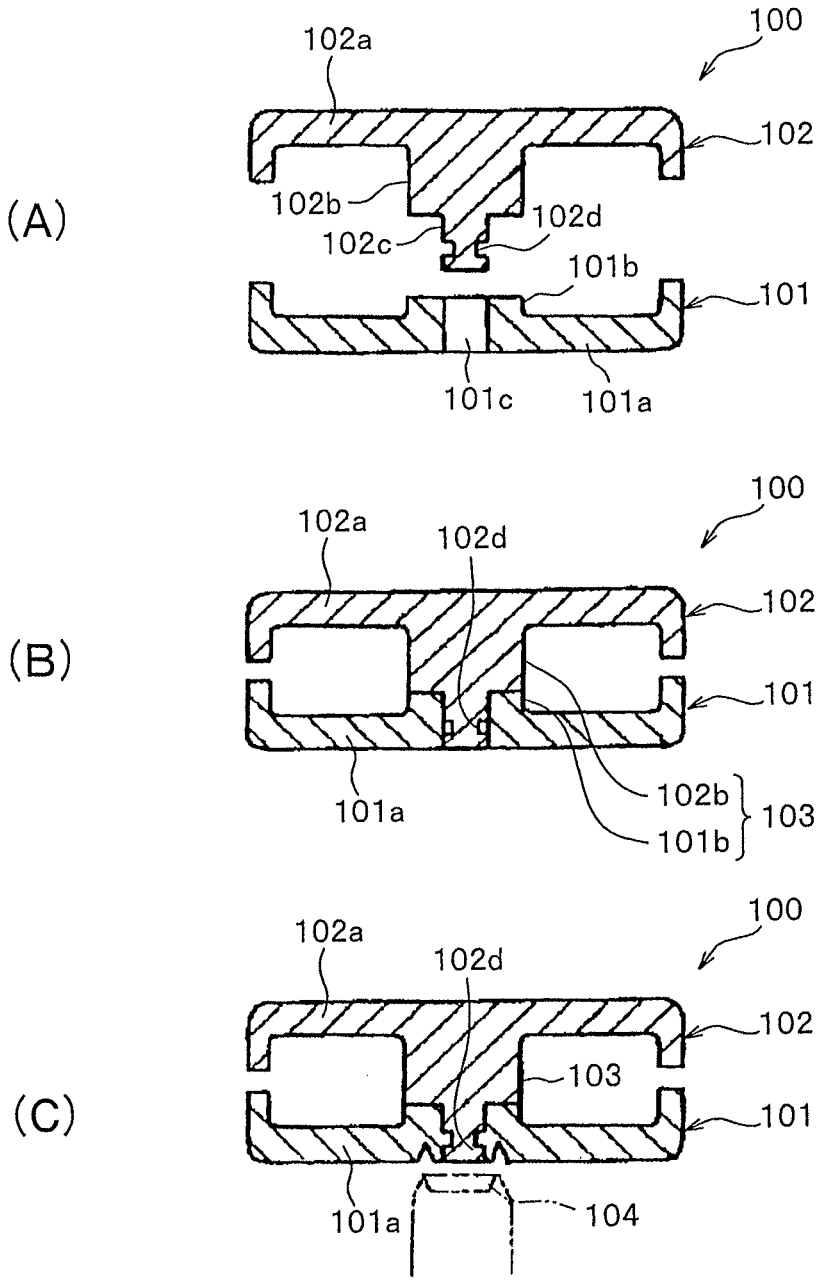
FIG. 20 are sectional views for explaining an assembling method of a conventional slider body.

FIG. 18 is a perspective view showing a slider body of a slider according to Example 6, and FIG. 19 is a sectional view of the slider body.

The slider of Example 6 includes the slider body 6 and a tab (not shown) which is rotatably held on the slider body 6 on a side of the upper blade 81. The slider is used for a slide fastener of a type in which a fastener element made of synthetic resin is injection molded on a fastener tape to form element rows for example.

The slider body 6 of Example 6 includes an upper blade 81, a lower blade 82, a guide column 83 for connecting shoulder opening side ends of the upper and lower blades 81 and 82 to each other, a tab-attaching column 84 placed on an upper surface side of the upper blade 81, upper flange sections 85 suspended along left and right side edges of the upper blade 81, and lower flange sections 86 standing along left and right side edges of the lower blade 82. In this case, the upper blade 81 of the slider body 6 can be set as a first blade of the invention, and the lower blade 82 can be set as a second blade of the invention. In the case of Example 6, the lower blade 82 can be set as the first blade of the invention, and the upper blade 81 can be set as the second blade of the invention.

The upper blade (first blade) 81 in Example 6 includes an upper blade first main body (first blade first main body) 81*a* having an element guide surface, and an upper blade second main body (first blade second main body) 81*b* attached to an upper surface side of the upper blade first main body 81*a*. The lower blade (second blade) 82 includes a lower blade first main body (second blade first main body) 82*a* having an element guide surface, and a lower blade second main body (second blade second main body) 82*b* attached to a lower surface side of the lower blade first main body 82*a*.

The slider body 6 in Example 6 includes a slider main member 91 having the upper blade first main body 81*a* and the lower blade first main body 82*a*, a slider first sub-member 92 attached to an upper surface side of the slider main member 91, and a slider second sub-member 93 attached to a lower surface side of the slider main member 91. In this case, the element guide surface of the slider body 6 is formed using the slider main member 91, the slider first sub-member 92 and the slider second sub-member 93.

Of the slider body 6, the slider main member 91 includes the upper blade first main body 81*a* of the upper blade 81, the lower blade first main body 82*a* of the lower blade 82, and the guide column 83 which connects the upper blade first main body 81*a* and the lower blade first main body 82*a* to each other. The entire slider main member 91 is integrally configured by injection molding or die casting molding.

By attaching the later-described upper blade second main body 81*b* of the slider first sub-member 92 to the upper blade first main body 81*a*, the upper blade first main body 81*a* and the upper blade second main body 81*b* configure the upper blade 81. By attaching the later-described lower blade second main body 82*b* of the slider second sub-member 93 to the lower blade first main body 82*a*, the lower blade first main body 82*a* and the lower blade second main body 82*b* configure the lower blade 82.

In this case, the upper blade first main body 81*a* of the slider main member 91 in Example 6 is configured substantially in the same manner as that of the upper blade first main body 61*a* of the slider main member 71 in Example 5. The lower blade first main body 82*a* of the slider main member 91 is configured substantially in the same manner as that of the lower blade first main body 17*a* of the slider main member 31 in Example 2.

The slider first sub-member 92 in Example 6 is configured substantially in the same manner as that of the slider sub-member 72 in Example 5. The slider second sub-member 93 in Example 6 is configured substantially in the same manner as that of the slider sub-member 32 in Example 2.

When the slider body 6 of Example 6 is assembled using the slider main member 91, the slider first sub-member 92 and the slider second sub-member 93, the slider first sub-member 92 is fitted to an upper surface side of the slider main member 91, the slider second sub-member 93 is fitted to a lower surface side of the slider main member 91 and they are assembled.

According to this, the slider body 6 of Example 6 in which the slider first sub-member 92 and the slider second sub-member 93 are stably fixed to the slider main member 91 with predetermined fixing strength is configured. According to the slider of Example 6 having such a slider body 6 also, the same working effects as those of Examples 1 to 5 can be exerted. The slider body 6 of Example 6 which is once assembled can again be disassembled into the slider main member 91, the slider first sub-member 92 and the slider second sub-member 93.

REFERENCE SIGNS LIST

1 slider body
1*a* slider
2, 3, 4 slider body
5, 6 slider body
8*a*, 8*b* slide fastener
9 tab
10 article
11 upper blade
12 lower blade
12*a* lower blade first main body

12*b* lower blade second main body
13 guide column
14 tab-attaching column
15 lower flange section
16*a* first bulge portion
16*b* second bulge portion
16*c* third bulge portion
17 lower blade
17*a* lower blade first main body
17*b* lower blade second main body
18 lower blade
18*a* lower blade first main body
18*b* lower blade second main body
19 lower blade
19*a* lower blade first main body
19*b* lower blade second main body
21 slider main member
21*a* first base portion
21*b* first fitted portion (fitted recess)
21*c* second fitted portion (projecting stripe)
21*d* positioning portion
22 slider sub-member
22*a* second base portion
22*b* first fitting portion
22*c* second fitting portion
22*d* foundation portion
22*e* extending portion
31 slider main member
31*a* first base portion
31*b* first fitted portion (fitted recess)
31*c* second fitted portion (fitted recess)
31*d* notch portion
32 slider sub-member
32*a* second base portion
32*b* first fitting portion (first hook)
32*c* second fitting portion (second hook)
32*d* foundation portion
32*e* positioning portion
32*f* cutout
32*g* tongue piece portion
41 slider main member
41*a* first base portion
41*d* notch portion
42 slider sub-member
42*a* second base portion
42*d* foundation portion
42*e* positioning portion
51 slider main member
51*a* first base portion
51*b* fitted portion (fitted recess)
51*d* notch portion
51*e* column insertion hole
51*f* first pin insertion hole
52 slider sub-member
52*a* second base portion
52*b* fitting portion
52*d* foundation portion
52*e* positioning portion
52*f* cutout
52*g* tongue piece portion
52*h* fixing column
52*i* second pin insertion hole
53 split pin member
53*a* slit
61 upper blade
61*a* upper blade first main body
61*b* upper blade second main body
62 lower blade
63 guide column
64 tab-attaching column
65 upper flange section
71 slider main member
71*a* first base portion
71*b* first fitted portion (fitted recess)
71*c* second fitted portion (fitted recess)
72 slider sub-member
72*a* second base portion
72*b* first fitting portion
72*c* second fitting portion
72*e* positioning portion
72*f* cutout
72*g* tongue piece portion
81 upper blade
81*a* upper blade first main body
81*b* upper blade second main body
82 lower blade
82*a* lower blade first main body
82*b* lower blade second main body
83 guide column
84 tab-attaching column
85 upper flange section
86 lower flange section
91 slider main member
92 slider first sub-member
93 slider second sub-member

The invention claimed is:

1. A slider for a slide fastener comprising:

a slider body comprising at least a first blade, a second blade opposed to the first blade, a guide column for connecting shoulder opening side ends of the first and second blades to each other, and a pair of first flange sections disposed on left and right side edges of the first blade and extending toward left and right side edges of the second blade; and a tab disposed on at least one of the first and second blades, wherein the slider body comprises an element guide passage surrounded by element guide surfaces, wherein:

the slider body comprises a slider main member and a slider sub-member formed independently from the slider main member, the slider main member comprises a first portion including at least an inner wall surface of the shoulder opening side end of the first blade and a second portion including at least an inner wall surface of the shoulder opening side end of the second blade and the guide column connecting integrally the first and second portions, the pair of first flange sections of the first blade are integrally formed with the slider sub-member, the slider sub-member is assembled with and fixed to the slider main member, and the element guide surfaces of the slider body comprise at least the inner wall surface of the first portion of the slider main member, the inner wall surface of the second portion of the slider main member and inner wall surfaces of the pair of the first flange sections of the slider sub-member.

2. The slider according to claim 1, wherein the inner wall surface of the first portion of the slider main member is continuous from a shoulder opening side end edge to a rear opening-side end edge, and the inner wall surface of the second portion of the slider main member is continuous from a shoulder opening side end edge to a rear opening-side end edge.

3. The slider according to claim 1, wherein the first blade comprises a first main body which is disposed on the slider main member and which includes the inner wall surface of the first portion, and a second main body which is disposed on the slider sub-member, which connects the pair of first flange sections, and which is assembled with the first main body.

4. The slider according to claim 3, wherein a fitting portion provided on the second main body is fitted into a fitted portion provided in the first main body, and the slider sub-member is assembled with and fixed to the slider main member.

5. The slider according to claim 4, wherein:

the fitted portion of the first main body of the slider main member comprises a recessed first fitted portion disposed in a shoulder opening side end of the first main body, and a second fitted portion outwardly projecting in a width direction of the slider from left and right side edges of the first main body, the second main body comprises a base portion, foundation portions which are disposed on left and right side edges of the base portion and which support the pair of first flange sections, and an extending portion which extends from the base portion toward a shoulder and which can resiliently deform, and the fitting portion of the second main body of the slider sub-member comprises a hook-shaped first fitting portion which stands on a tip end of the extending portion and which is fitted into the first fitted portion, and a concave groove-shaped second fitting portion which is recessed in the foundation portion and which is fitted into the second fitted portion.

6. The slider according to claim 4, wherein:

the fitted portion of the first main body of the slider main member comprises a concave groove-shaped first fitted portion disposed in a shoulder opening side end of the first main body, a concave groove-shaped second fitted portion placed in a rear opening-side end of the first main body, and the second main body comprises a hook-shaped first fitting portion which is disposed on a shoulder opening side end of the second main body and which can be fitted into the concave groove-shaped first fitted portion of the fitted portion of the first main body, and a hook-shaped second fitting portion which is disposed on a rear opening-side end of the second main body and which can be fitted into the concave groove-shaped second fitted portion of the fitted portion of the first main body.

7. The slider according to claim 6, wherein:

the second main body comprises a base portion, a pair of cutouts formed on a rear opening-side end of the base portion, and a tongue piece portion which is sandwiched between the pair of cutouts and which can resiliently deform, and the hook-shaped first fitting portion stands on a shoulder opening side end of the base portion, and the hook-shaped second fitting portion stands on a rear opening-side end of the tongue piece portion.

8. The slider according to claim 1, wherein the slider sub-member is assembled with and fixed to the slider main member by adhesion or welding.

9. The slider according to claim 1, the slider sub-member is assembled with and fixed to the slider main member using a fixing member.

10. The slider according to claim 1, wherein:

a pair of second flange sections extending toward the first blade is disposed on the left and right side edges of the second blade, the slider body further comprises a slider second sub-member formed independently from the slider main member and the slider sub-member, the pair of second flange sections is integrally formed on the slider second sub-member, and the slider second sub-member is assembled with and fixed to the slider main member.

11. A method for repairing a slide fastener wherein a slider attached to a slide fastener is replaced with the slider according to claim 1, thereby repairing the slide fastener.

* * * * *